US006652177B2

(12) United States Patent
Shimada et al.

(10) Patent No.: US 6,652,177 B2
(45) Date of Patent: Nov. 25, 2003

(54) CONICAL NIB, METHOD OF MANUFACTURE OF THE SAME, AND CERAMIC COMPOSITE CONICAL NIB

(75) Inventors: Nobuhiko Shimada, Itabashi-ku (JP); Shizuo Yamanaka, Mitaka (JP)

(73) Assignee: Kazue Yamanaka, Tokyo (JP)

( * ) Notice: Subject to any disclaimer, the term of this patent is extended or adjusted under 35 U.S.C. 154(b) by 0 days.

(21) Appl. No.: 10/306,272

(22) Filed: Nov. 27, 2002

(65) Prior Publication Data

US 2003/0152415 A1 Aug. 14, 2003

(30) Foreign Application Priority Data

Nov. 30, 2001 (JP) ..... 2001-367088
May 22, 2002 (JP) ..... 2002-147106

(51) Int. Cl.[7] ..... B43K 5/00

(52) U.S. Cl. ..... 401/233; 401/221; 401/224; 401/231; 401/235; 401/265; 401/292

(58) Field of Search ..... 401/221, 224, 401/231, 233, 235, 261, 264, 265, 292

(56) References Cited

U.S. PATENT DOCUMENTS 882,179 A * 3/1908 Smith ..... 401/233
1,878,879 A * 9/1932 Mon ..... 401/121
3,518,019 A 6/1970 Nakamura
4,531,853 A 7/1985 Hirabayashi et al.
5,902,064 A * 5/1999 Yamanaka ..... 401/292

* cited by examiner

*Primary Examiner*—Tuan N. Nguyen
(74) *Attorney, Agent, or Firm*—Haynes and Boones, LLP.

(57) ABSTRACT

A highly durable conical nib is provided which also realizes a significant improvement in a nib productivity and a significant cost reduction. The conical nib comprises: a plurality of separated combtooth pieces being able to converge progressively toward front ends thereof and combine to form a virtually conical shape and that the front ends thereof combine to form a virtually spherical shape; a holding member capable of arranging the combtooth pieces along a circumference; and a converging member capable of converging these combtooth pieces; wherein the plurality of separated combtooth pieces are assembled by the holding member and the converging member, both separate from the combtooth pieces, into a conical nib having a writing tip at the front end thereof and an ink feeding path between each combtooth piece. To enhance durability, this nib may be constructed of a base portion and a plurality of combtooth pieces and hemisphere-divided portions wherein each of the combtooth pieces is divided into a front piece and a rear piece and the front piece is formed from a ceramic material and the rear piece from a flexible material such as synthetic resin.

7 Claims, 28 Drawing Sheets

CONICAL NIB, METHOD OF MANUFACTURE OF THE SAME, AND CERAMIC COMPOSITE CONICAL NIB

BACKGROUND OF THE INVENTION

1. Field of the Invention

The present invention relates to a nib for use with fountain pens and other writing instruments and to a method of manufacturing the same. The present invention also relates to a composite conical nib made from a ceramic material with excellent durability.

2. Description of Prior Art

Writing instruments such as fountain pens have conventionally been using nibs with high durability. In the case of a fountain pen, a nib is tipped with a wear-resistant alloy by fusing, formed with a slit and polished at corners to round a tip of the nib. As an example of such a conventional nib, a conical nib is shown in FIG. 1. In FIG. 1 reference numeral 100 represents a nib comprising a nib base body 200 molded of a resin and having a predetermined thickness and a converging member 300.

The nib base body 200 is integrally molded of a synthetic resin material by injection molding and, as shown in FIG. 2, has a cylindrical base portion 201 and a plurality of combtooth pieces 202 protruding from one end of the base portion 201. These combtooth pieces 202 are arranged along a circumference, centered at a center axis of the nib, at equal intervals with a slit 203 formed therebetween. The base portion 201 has a large-diameter portion 211 and a small-diameter portion 212 with a stepped portion 213 formed at a boundary between them. The combtooth pieces 202, each shaped like an arc in cross section, protrude continuously from one end of the large-diameter portion 211 of the base portion 201 and progressively taper off toward the front end. A base portion-side half of each combtooth piece 202 extends almost linearly along an outer circumferential surface of the large-diameter portion 211 and a front end-side half tilts inwardly so that the combtooth pieces 202 progressively approach the center axis toward the front end. The combtooth pieces 202 as a whole are brought closer together inwardly by urging them from their outer circumference toward the center axis. That is, the base end side halves are combined together in a virtually cylindrical shape and the front end side halves in a virtually conical shape. The combtooth pieces 202 have hemisphere-divided portions 204 at their front ends which, when brought together, form a hemisphere. The hemisphere-divided portions 204 are rounded at their outer corners.

The converging member 300, as shown in FIG. 1, is formed into a cylinder that can be fitted over an intermediate portion of the nib base body 200. The converging member 300 has an inner circumferential structure adapted to press the combtooth pieces 202 toward the center axis to converge into a conical shape that progressively decreases in diameter toward the front end.

The nib 100 has the nib base body 200 and the converging member 300 of the above construction as constitutional elements. The converging member 300 is sleeved over the nib base body 200 from its front end and snugly fitted over the circumference of the nib base body 200, so that the inner circumferential structure of the converging member 300 presses the combtooth pieces 202 from outside toward the center axis. Under a uniform pressure of the converging member, the base end side halves converge into an almost cylindrical geometry without distortion and the front end side halves also converge into an almost conical geometry without distortion whose diameter progressively decreases toward the front end. As a result, the adjoining combtooth pieces 202 engage with each other, bringing together the hemisphere divided portions 204 at their front ends to form a smooth hemisphere writing tip 400 with no undulations. In this condition, ink feeding paths 500, capillary-like gaps, are formed between side interfacing portions of the combtooth pieces 202.

In the nib 100 constructed as described above, when the semispherical writing tip 400 is pressed against a surface of writing paper with the pen axis at an angle, the hemisphere divided portions 204 at the free ends of the combtooth pieces 202 slip relative to each other and elastically deform to enlarge an outer diameter of the hemisphere portion at the tip. When the pressing force is removed, the tip of the nib restores its original shape by its elasticity. This behavior allows the nib to write on a paper surface in any direction and, even if the nib is rotated about the pen axis, to write at any position on the hemispherical tip portion and at any angle. Further, the thickness of a line can be changed by adjusting a writing pressure, permitting the writer to write a variety of modes of letters with a changing line width, such as those produced by a writing brush.

The conventional conical nibs, however, have the following problems.

(1) Since the nib base body is molded in the form of a set of combtooth pieces that together have a conical shape, it has a complex geometry, making molding dies complex and expensive and rendering a mass production impossible.

(2) Since the nib base body is molded in the form of a set of combtooth pieces that together have a conical shape, a check to see whether each of the combtooth pieces has a predetermined dimensional accuracy can only be made after the combtooth pieces are assembled into a final product as by fitting a ring over them.

(3) To give a smooth writing feel requires rounding outer surface corners of the tip portion. The outer surface corners are rounded as by a barrel polisher. During this process, the combtooth pieces interfere with each other at slit portions, making it necessary to check that the rounding is being carried out as desired in the middle of the process. This degrades an efficiency of the chamfering or rounding work.

(4) To make the nib of the pen a final product after the rounding operation requires fitting a ring (converging member) over the nib front end portions divided like combteeth. An attempt to perform this ring fitting operation by using an automated assembly machine results in the combtoothlike molded pieces of the nib base body interfering with each other at slit portions and the nib base body failing to rest in its place on an automated feeding apparatus such as a parts feeder. The ring fitting operation must therefore be done manually.

Of the conventional nibs described above, ceramic nibs are drawing attention as highly wear-resistant nibs. Examples of ceramic nibs are disclosed in Japanese Utility Model Disclosure Nos. 60-8085, 60-109979 and 1-86578, and Japanese Patent Disclosure No. 1-146797. Some of the proposed ceramic nibs of this kind have a construction in which a nib body of ceramic plate is formed with a slit and has its tip rounded or in which a barlike nib body is formed with a longitudinal through-hole as an ink feeding hole to supply ink to the tip.

The conventional ceramic nibs, however, has the following drawbacks. Although the ceramic nib has a groove or through-hole for feeding ink, since it is hard and cannot deflect as can a platelike stamped metal nib, the groove or through-hole cannot deal with a change in ink viscosity or with ink scum, resulting in an interruption of ink feed. Further, fine dirt and paper dust produced by contacts between the writing tip of the nib and a paper surface may clog an ink path in the nib body. If that happens, since the nib has almost no provisions for cleaning, the writing performance inevitably becomes unstable. These problems are a major reason that the ceramic nibs, though they use a wear-resistant material, have not been put to practical use and that pens using a ceramic nib have not been able to be marketed as practical writing instruments.

SUMMARY OF THE INVENTION

According to one aspect of the present invention, there is provided a conical nib having a plurality of independent combtooth pieces which can converge progressively toward the front ends thereof and combine to form a virtually conical shape over the entire length and a virtually spherical shape at the front ends. These combtooth pieces are each shaped like a pointed knife and their base end portions are used as fixed portions to be inserted into the holding member for fixing. The holding member is formed almost cylindrical and has at one end face thereof groove-shaped fixing portions into which the fixed portions of the combtooth pieces can be axially inserted, and the combtooth pieces are inserted into the fixing portions of the holding member to arrange the base end portions along a circumference. Further, the nib has a converging member which can be fitted over an outer circumference of the combtooth pieces arranged along the circumference by the holding member and which presses the combtooth pieces inwardly from outside to converge them. A plurality of combtooth pieces are assembled by the holding member and the converging member into a conical nib having a writing tip at the front end thereof and an ink feeding path between each combtooth piece.

With this arrangement, the conical nib can be simplified in structure, greatly improving its productivity and realizing a substantial cost reduction.

Another aspect of the present invention provides a method of manufacturing a conical nib which comprises the steps of: forming a plurality of separated combtooth pieces, the combtooth pieces being able to be converged generally into a virtually conical shape, the combtooth pieces having front ends that combine to form a virtually spherical shape; forming a holding member having groove-shaped fixing portions into which base end portions of the plurality of combtooth pieces can be inserted, the holding member being able to arrange the base end portions of the combtooth pieces along a circumference; and forming a converging member capable of being fitted over an outer circumference of the combtooth pieces arranged along the circumference by the holding member to converge the plurality of combtooth pieces; inserting the plurality of combtooth pieces into the fixing portions of the holding member to fix them along the circumference; and fitting the converging member over the outer circumference of the plurality of combtooth pieces to converge the combtooth pieces.

With this manufacturing method, it is possible to automate step of, after the constitutional parts of the conical nib have been prepared, inserting the plurality of combtooth pieces into the fixing portions of the holding member for fixing and a step of fitting the converging member over the outer circumference of the plurality of combtooth pieces. This greatly improves the productivity of the conical nib and also realizes a substantial cost reduction.

Because of the improvements made on the conical nib structure and on the manufacturing process thereof as described above, the present invention offers the following effects and advantages.

Since the shape of the product is simplified, the cost of dies can be reduced to about one-half the conventional one.

The conventional molding process requires a large and strong press. The improvement of the conical shape enables the use of a small press, which in turn reduces the facility cost.

The nib of the conventional construction can only be manufactured at the rate of 150–200 nibs per minute at most. The adoption of the nib construction of this invention increases the rate of production to 5,000 nibs per minute (5 nibs as one set), which is five times the conventional production rate, resulting in a significant reduction in the production cost.

Since the combtooth pieces of the nib are formed as single, separate parts, the dimensional accuracy can easily be checked, preventing faulty parts from getting into the production line.

Since the combtooth pieces of the nib are individually subjected to the process of chamfering or rounding the outer surface corners of the front end of each combtooth piece, the problem of the combtooth pieces interfering with one another is eliminated, enabling a large quantity of nibs to be manufactured in a short period of time. Furthermore, the assembly of individual combtooth pieces can be done by using an automated feeding apparatus, such as parts feeder, thus realizing a substantial cost reduction.

Still another aspect of the present invention provides a ceramic composite conical nib which comprises: a nib base body having a cylindrical base portion, a plurality of combtooth pieces formed at one end of the base portion along a circumference, centered at a center axis thereof, the combtooth pieces being able to converge progressively toward front ends thereof and combine to form a virtually conical shape, and a plurality of hemisphere-divided portions formed at the front ends of the combtooth pieces, the hemisphere-divided portions being able to converge and combine to form a virtually hemispherical tip portion; and a converging member formed cylindrical and being able to be fitted over an outer circumference of the nib base body to converge the plurality of combtooth pieces and the hemisphere-divided portions thereof; wherein each of the combtooth pieces has a front piece on a front end side thereof including the hemisphere-divided portion and a rear piece on a rear end side thereof; wherein the front piece is formed from a ceramic material; wherein the rear piece is formed elastically deformable from a synthetic resin or metal material; wherein the nib base body is converged by the converging member to form an ink feeding path between each combtooth piece and also form a spherical writing tip at a front end thereof.

With this construction, since the tip of the nib is formed of a ceramic material, not only can the tip have a high wear resistance and therefore an enhanced durability but it can also offer a smooth writing feel and produce smooth written lines. Further, because the hemisphere-divided portions of the writing tip shift relative to one another and as a whole deform elastically as a result of elastic deformations of the rear pieces according to the writing pressure applied, the writing tip of the nib, though made of a hard ceramic material, can prevent an interruption of ink feed which would otherwise be caused by an ink viscosity change due to drying of ink or by dried ink scum. Further, if dirt or paper dust adheres to ink paths, the above-described behavior of the writing tip can reliably remove it, assuring a stable writing action. Furthermore, the elastic deformation of the writing tip offers a soft paper-contacting feel and allows the nib to write at any angle to a paper surface and, even if the nib is rotated about the pen axis, at any position on the hemispherical tip portion. It is also possible to draw a line thick or thin by adjusting the writing pressure.

The characteristic features of the present invention may be summarized as follows.

First, the number of combtooth pieces of the nib base body is set to five to eight.

Second, the base portion and the rear piece of each combtooth piece are integrally formed from a synthetic resin or metal material.

Third, one of engagement surfaces of the front piece and the rear piece is provided with an engagement projection and the other engagement surface with an engagement recess. The engagement between these engagement projection and recess connects the front piece and the rear piece.

As described above, since the tip of the nib is made from a ceramic material, the tip has high wear resistance and durability and offers a soft writing feel and produces smooth written lines. Further, because the hemisphere-divided portions of the writing tip shift relative to one another and as a whole deform elastically as a result of elastic deformations of the rear pieces according to the writing pressure applied, the writing tip of the nib, though made of a hard ceramic material, can prevent an interruption of ink feed which would otherwise be caused by an ink viscosity change due to drying of ink or by dried ink scum. Further, if dirt or paper dust adheres to ink paths, the above-described behavior of the writing tip can reliably remove it, assuring a stable writing action. Furthermore, the elastic deformation of the writing tip offers a soft paper-contacting feel and allows the nib to write at any angle to a paper surface and, even if the nib is rotated about the pen axis, at any position on the hemispherical tip portion. It is also possible to draw a line thick or thin by adjusting the writing pressure.

Therefore, a first object of this invention is to simplify the structure of the conical nib to realize a significant improvement in productivity while greatly reducing cost.

A second object of this invention is to improve the conical pen manufacturing process to realize productivity improvements and cost reductions.

A third object of this invention is to provide a ceramic composite conical nib which can enhance a durability of the writing tip of the nib, and also give a writer a smooth writing feel and produce smooth written lines.

A fourth object of this invention is to provide a ceramic composite conical nib which, though the tip of the nib is made from a hard ceramic material, can offer a soft paper-contacting feel and enables the nib to write at any angle to a paper surface and, even if the nib is rotated about the pen axis, at any position on the hemispherical tip portion.

These objects and advantages of the present invention will become more apparent from the following description of preferred embodiments thereof taken in conjunction with the accompanying drawings.

DESCRIPTION OF THE PREFERRED EMBODIMENTS (Embodiment 1)

Figure 1:
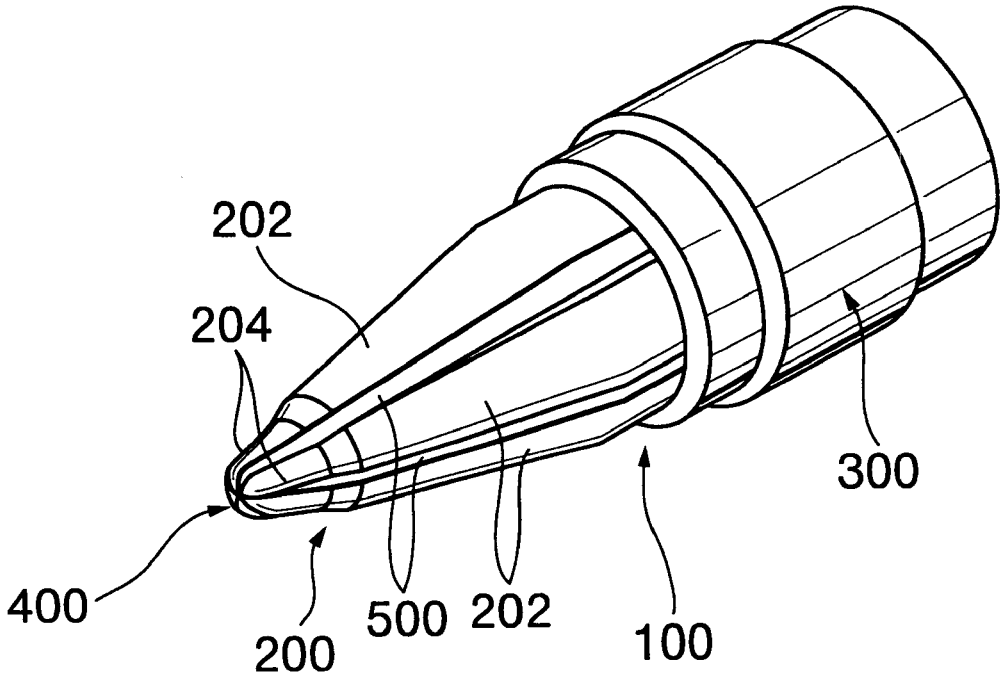
FIG. 1 Prior Art
FIG. 1 is a perspective view of a conventional conical nib.
Figure 2:
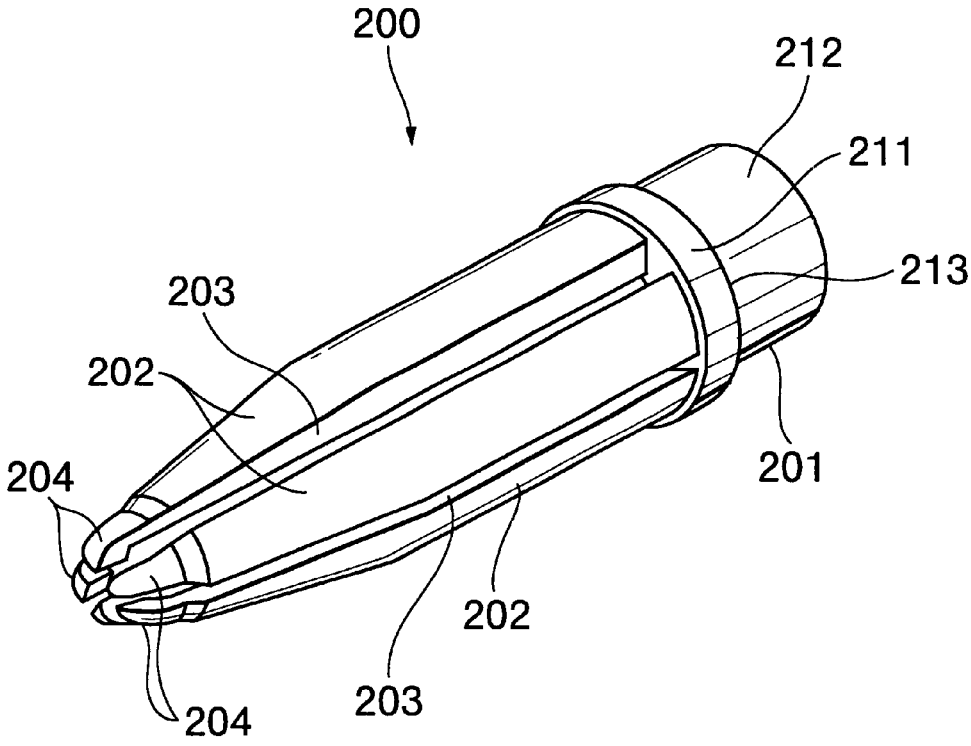
FIG. 2 Prior Art
FIG. 2 is a perspective view showing a nib base body of the conventional conical nib.
Figure 3:
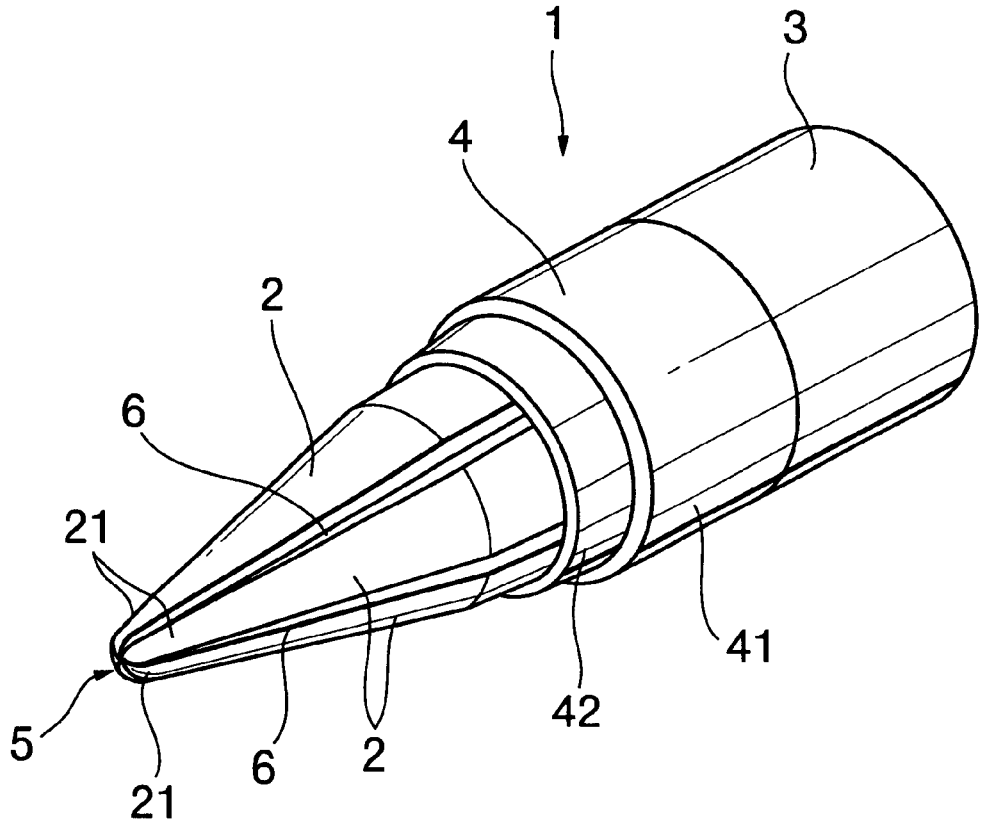
FIG. 3 is a perspective view showing a conical nib according to a first embodiment of the present invention.

Now, embodiments of the present invention will be described by referring to the accompanying drawings. FIG. 3 is a perspective view of a conical nib according to a first embodiment of this invention. In FIG. 3, designated 1 is a conical nib (hereinafter simply referred to as a nib) which has a plurality of combtooth pieces 2, a holder member 3, and a converging member 4. The combtooth pieces 2 are assembled by the holder member 3 and the converging member 4 to form a conical nib that has a writing tip 5 at the front end thereof and ink feeding paths 6 between the combtooth pieces 2.

Figure 4A:
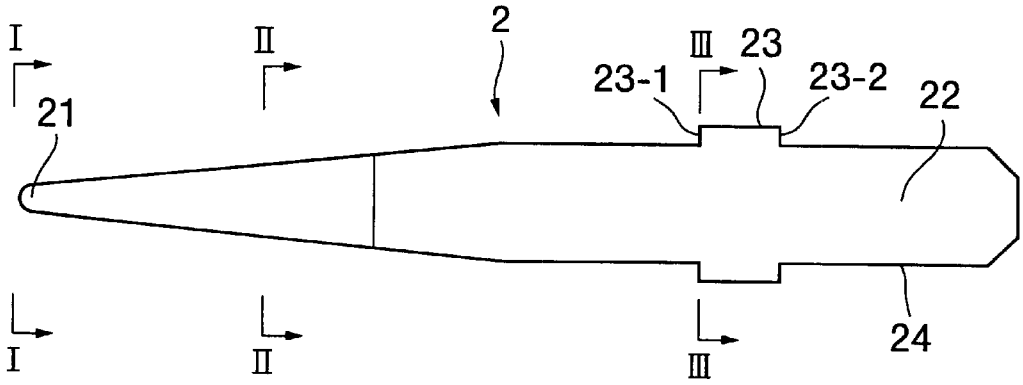
FIG. 4A is a plan view showing one of combtooth pieces of the nib.
Figure 4B:
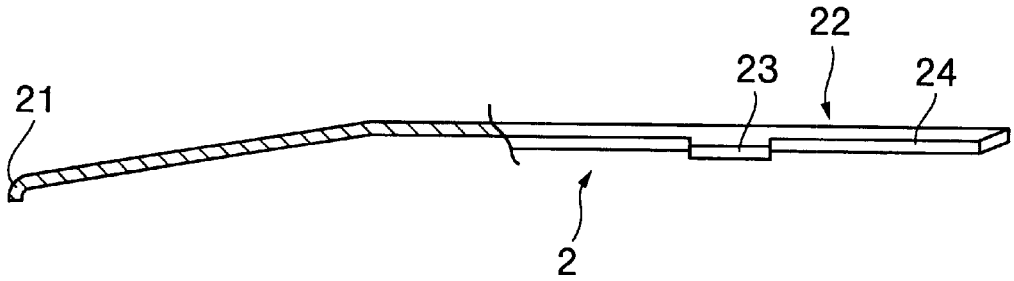
FIG. 4B is a partial cross-sectional side view showing one of combtooth pieces of the nib.
Figures 4C, 4D, 4E:
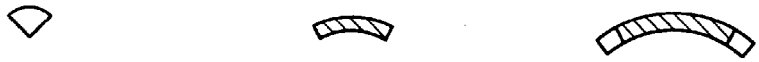
FIG. 4C is a cross-sectional view of each combtooth piece of the nib (taken along the line I—I in FIG. 4A).
FIG. 4D is a cross-sectional view of each combtooth piece of the nib (taken along the line II—II in FIG. 4A).
FIG. 4E is a cross-sectional view of each combtooth piece of the nib (taken along the line III—III in FIG. 4A).
Figure 5:
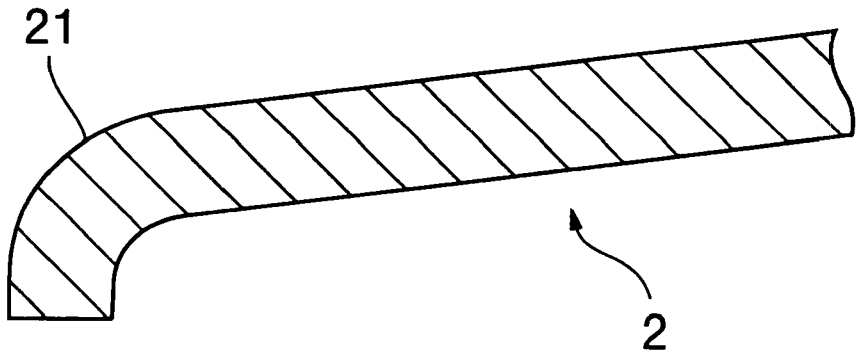
FIG. 5 is an enlarged, partial cross-sectional side view showing an essential part of each combtooth piece of the nib.
Figure 8:
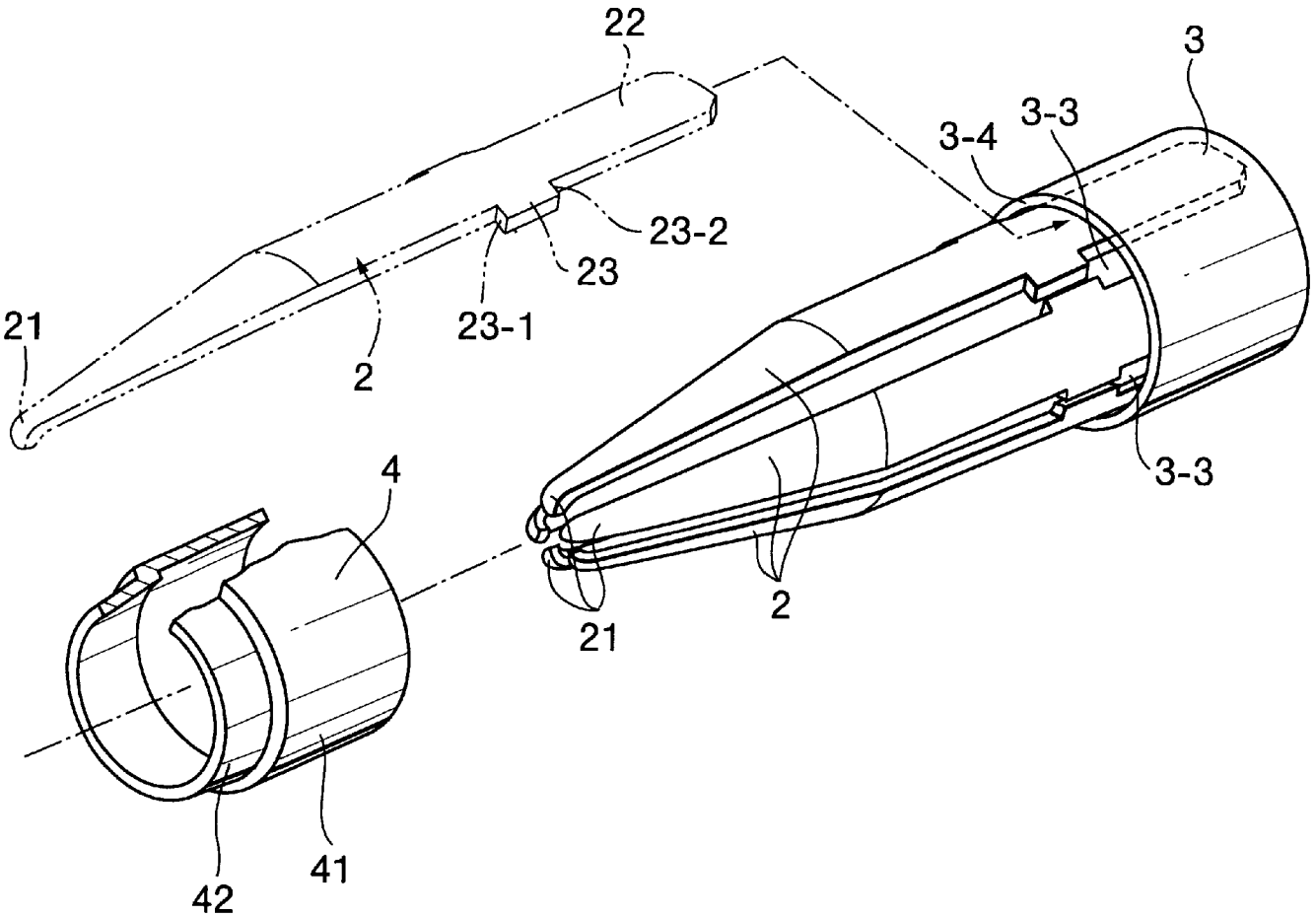
FIG. 8 is a perspective view showing a state of a plurality of combtooth pieces of the nib secured to the holder member before a converging member is fitted.

A plurality of combtooth pieces 2 are constructed to be able to converge progressively toward the front end and combine to form a roughly conical nib body with a roughly semispherical front end. Each of the combtooth pieces 2 is generally shaped like a pointed knife, as shown in FIG. 4A, curved widthwise in arc in cross section, as shown in FIG. 4B and FIGS. 4C–4E, and at its front end formed with a hemisphere-divided portion 21, as shown in FIG. 5. Further, as shown in FIG. 4A, a base end portion 22 of each combtooth piece 2 is adapted to be secured to the holder member 3 and has a flange portion 23 and an expanded width portion 24 wider than the front end side of the combtooth piece 2. The flange portion 23 has a flange portion front side 23-1 and a flange portion rear side 23-2. The flange portion front side 23-1 is used as a push force receiving portion against which an insertion jig is pressed to insert the base end portion 22 into the holder member 3. The flange portion rear side 23-2 abuts against a front end of a fixing portion of the holder member 3 to stop the base end portion 22 at its predetermined position for fixing. At this time, keeping a distance between the flange portion rear side 23-2 and the front end of the combtooth piece 2 to a predetermined length with high precision for all combtooth pieces 2 ensures that, when a predetermined number of combtooth pieces 2 are inserted into the holder member 3 along the circumference thereof as shown in FIG. 8, the front ends of the combtooth pieces 2 conform to the conical geometry of the nib. That is, though separate and independent of each other, the combtooth pieces 2 when assembled are aligned at the front end with high precision to form a smooth writing tip 5. It is preferred that five to eight combtooth pieces 2 be used. These combtooth pieces 2 are made from metal, resin or ceramic or a combination of these.

Figure 6:
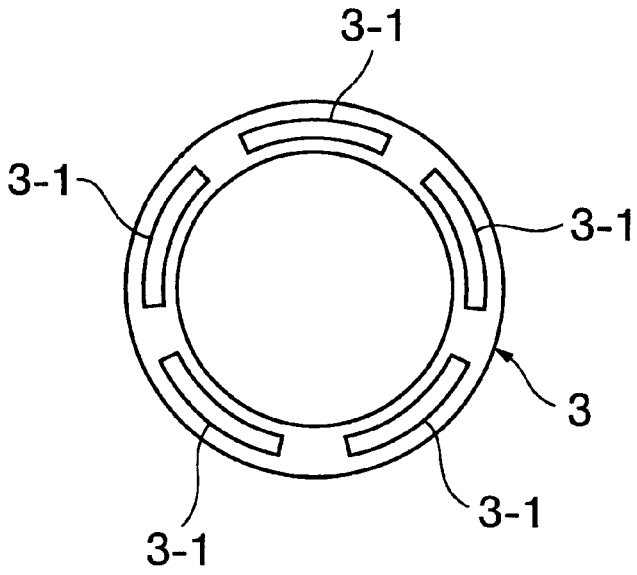
FIG. 6 is an end view of a holder member for the nib.

The holder member 3 is generally formed cylindrical as shown in FIG. 6 and, at one end face thereof, has slotlike fixing portions 3-1 into which the base end portions 22 (which are to be fixed) of the combtooth pieces 2 are inserted axially (of the holder member 3). The base end portions 22 of the combtooth pieces 2 are inserted into the fixing portions 3-1 of the holder member 3 so that they are arranged on the circumference (of one end face of the holder member 3). The holder member 3 is formed from metal or resin, or a combination of these.

Figure 7:
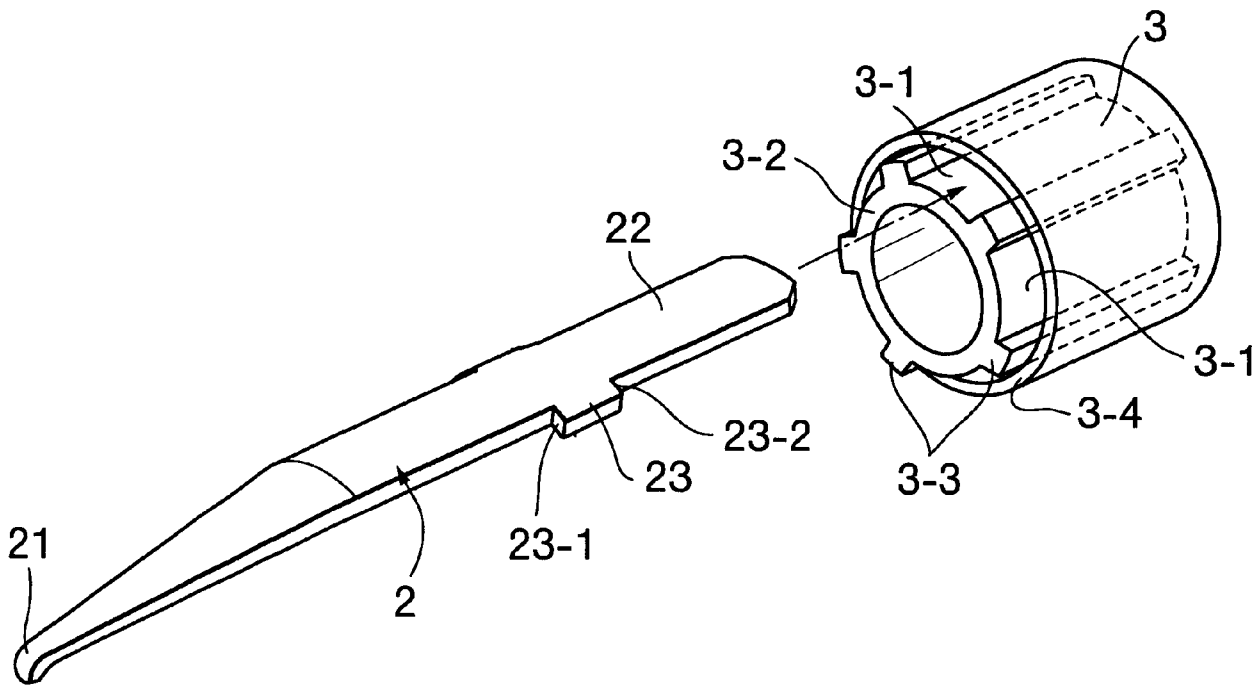
FIG. 7 is a perspective view of a variation of the holder member used on the nib.

A variation of the holder member 3 is shown in FIG. 7. This holder member 3 has its cylindrical body divided in two layers. An inner layer cylindrical body 3-2 is made from a resin material by injection molding. This molded member has a plurality of projections 3-3 arranged at equal intervals on its outer circumference that extend over the same length as the molded cylindrical body 3-2. A metal pipe 3-4 as an outer layer is fitted under pressure over an outer circumference of these projections 3-3 to form the holder member 3. Spaces formed between the metal pipe 3-4 and the projections 3-3 constitute the fixing portions 3-1 into which to insert and fix the base end portions 22 of the combtooth pieces 2. This construction enables the combtooth pieces 2 to be arrayed in cylindrical geometry on the outer side of the inner layer cylindrical body 3-2 and on the inner side of the outer layer pipe 3-4. Further, since the outer layer pipe 3-4 is formed of metal, the base end portions 22 of the combtooth pieces 2 can be firmly secured in the spatial fixing portions 3-1, guided by the projections 3-3, without any lateral deviations. The outer layer metal pipe 3-4 can also formed thin to minimize a radial difference between the outer circumferential surface of the outer layer pipe and the arrangement circle of the combtooth pieces 2 while at the same time preventing outward deformations of the outer layer pipe. Thus, the overall construction can be made compact. The cylindrical body 3-2 with the projections 3-3 can also be formed, with improved productivity, by extrusion-molding resin or metal material and cutting to desired lengths.

Figure 9:
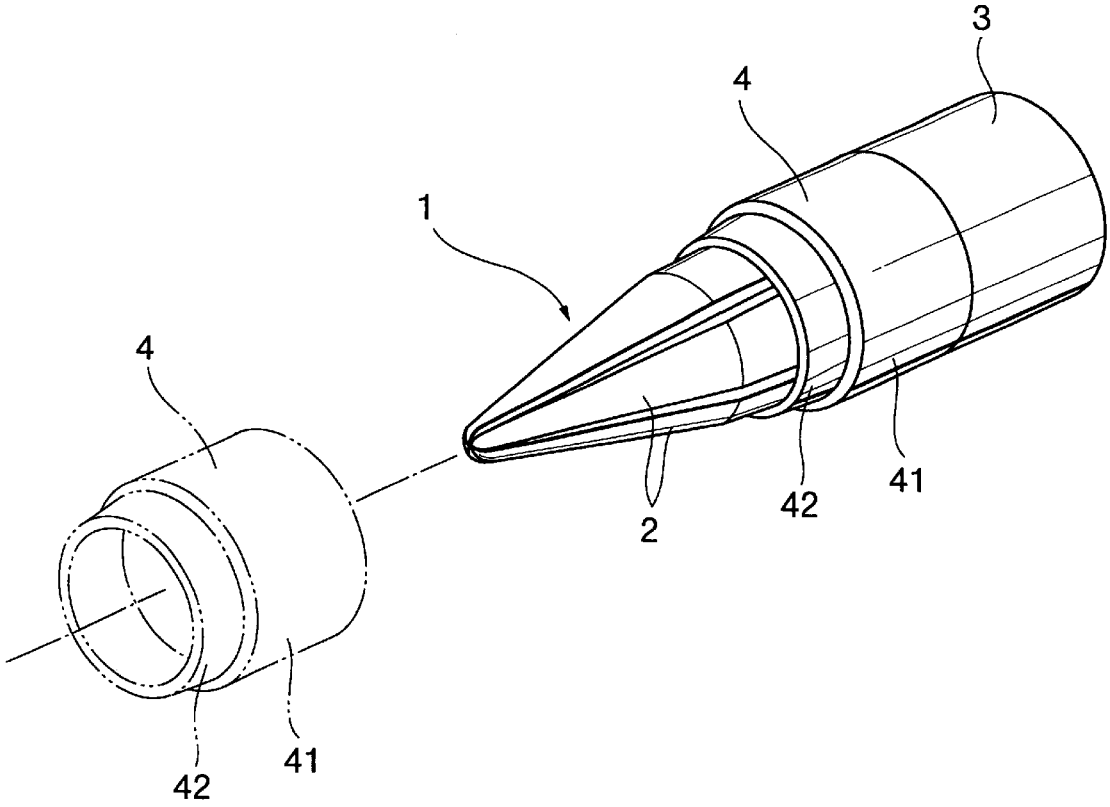
FIG. 9 is a perspective view showing a state of a plurality of combtooth pieces of the nib secured to the holder member after a converging member has been fitted.

The converging member 4, as shown in FIG. 3, FIG. 8 and FIG. 9, comprises an almost cylindrical converging portion 41 and a frustoconical throttling portion 42. The converging portion 41 is formed cylindrical so that it can be fitted over the outer circumference of the combtooth pieces 2 arranged along the circumference of the holder member 3. The converging portion 41 has an outer diameter almost equal to that of the holder member 3 and an inner diameter that can press intermediate portions of the combtooth pieces 2 on the base end portion side from the outside toward the inside to converge them into an almost cylindrical shape. The throttling portion 42 has its outer diameter and inner diameter progressively decrease toward the front end so as to press intermediate portions of the combtooth pieces 2 on the front end portion side from the outside toward the inside to converge these combtooth pieces 2 into an almost conical shape and also the hemisphere-divided portions 21 into a virtually hemispherical shape. The converging member 4 is formed from metal or resin, or a combination of these. The converging member 4 may also be formed as a mouth piece to attach the nib 1 to a body of a pen shaft.

Now, a method of manufacturing the nib 1 is briefly explained here. A process of manufacturing the nib 1 comprises a molding process and an assembly process. The molding process molds constitutional parts of the nib 1, i.e., a plurality of combtooth pieces 2, a holder member 3 and a converging member 4. The assembly process consists of a securing step for inserting the base end portions 22 of the combtooth pieces 2 into the fixing portions 3-1 of the holder member 3 to fix them along the circumference of the holder member 3 (see FIG. 8) and a converging step for fitting the converging member 4 over the outer circumference of the combtooth pieces 2 to converge them (FIG. 9). The process of inserting the combtooth pieces 2 into the fixing portions 3-1 of the holder member 3 involves pushing a stepped portion on the front side 23-1 of the flange portion 23 of each combtooth piece 2 until a step portion on the rear side 23-2 of the flange portion 23 abuts against the holding portion (projections 3-3 in the case of FIG. 7).

In the molding process, the nib 1 is constructed of three kinds of constitutional parts. Of these constitutional parts, the combtooth pieces 2 are simplified in shape, which in turn renders dies used for their molding significantly simplified. The combtooth pieces 2 in particular need to have a reliable dimensional precision because they must meet various geometrical requirements. For example, the combtooth pieces 2 generally taper off with their widths progressively decreasing toward the front end and incline inwardly toward the front end, approaching the center axis; the combtooth pieces 2 are also shaped in arc in transverse cross section; and the hemisphere-divided portions 21 at the front end are each formed to ⅕ to ⅛ the size of the hemisphere depending on the number of the combtooth pieces 2 used in the nib. Since the combtooth pieces 2 are fabricated individually, their dimensional accuracies can be checked easily thus preventing faulty parts from being used. Further, outer surface corners of each hemisphere-divided portion 21, i.e., corners formed by an outer surface of the hemisphere-divided portion 21 and its side surfaces, are polished as by blasting, barrel polishing and buffing to round them (or give them an R surface) so that the hemisphere-divided portions 21 do not get caught in a paper surface when they come into contact with it. These combtooth pieces 2 are separate from one another before being assembled and thus their rounding or chamfering operations are easily carried out.

Figure 10:
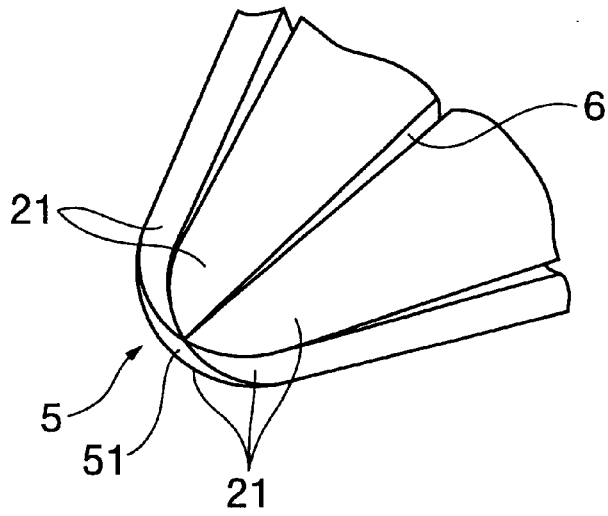
FIG. 10 is a perspective view showing a writing tip of the nib.
Figure 11:
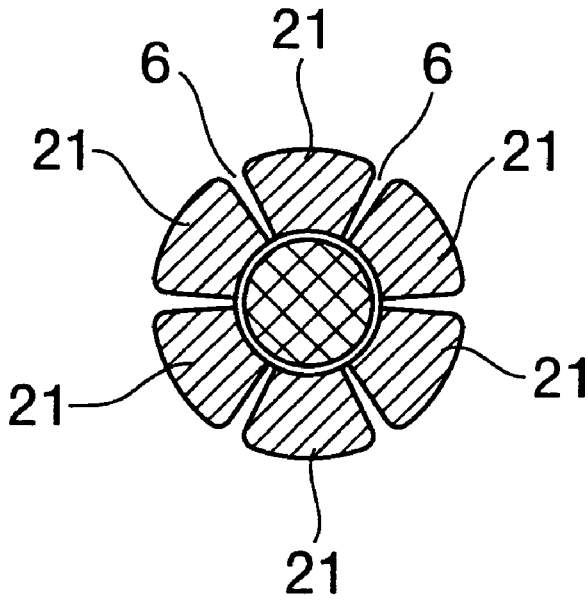
FIG. 11 is a cross-sectional view showing the writing tip of the nib.

In the assembly process, since parts are simplified in shape, they can be put on an automated feeding apparatus such as parts feeder for easy assembly. The assembly line can be automated easily because the assembly process only involves simple steps of inserting the combtooth pieces 2 into the fixing portions 3-1 of the holder member 3 and fitting the converging member 4 over the outer circumference of the combtooth pieces 2. In the step of inserting five to eight combtooth pieces 2 into the fixing portions 3-1 of the holder member 3, the combtooth pieces 2 are arranged at equal intervals along a circumference of the center axis, with a slit formed between them. These combtooth pieces 2 are connected to one end face of the holder member 3, with base end side halves of the exposed portions of the combtooth pieces 2 extending linearly from the end face of the holder member 3 and with front end side halves inclining in a direction in which it progressively approaches the center axis toward the front end, like a beak of a bird. Thus, each of the combtooth pieces 2 is shaped in cross section like one of divided, curved segments of a cone and is connected to the holder member 3. In this construction each combtooth piece 2 is supported like a cantilevered triangular plate with one end fixed in the fixing portion 3-1 of the holder member 3, i.e., it has the same structure as a cantilevered beam with one end fixed. Following the assembly of the combtooth pieces 2 and the holder member 3, the next operation of fitting the converging member 4 over the outer circumference of the combtooth pieces 2 is performed. In this case, the converging member 4 is sleeved until a circumferential end face of the converging portion 41 abuts against a circumferential end face of the holder member 3. The converging portion 41 of the converging member 4 presses the base end side portions of five to eight combtooth pieces 2 from the outer circumference toward the center axis to converge the intermediate portions of the combtooth pieces on the base end side inwardly into an almost cylindrical shape. At the same time, the throttling portion 42 of the converging member 4 presses the intermediate portions of these combtooth pieces 2 on the front end side from the outer circumference toward the center axis to converge them inwardly, causing the intermediate to front end portions of the combtooth pieces 2 to assume a conical geometry, with the hemisphere-divided portions 21 at the front ends of the combtooth pieces 2 combined to form a hemisphere. A uniform pressure of the converging member 4 ensures that the base end side portions of five to eight combtooth pieces 2 converge into a cylindrical shape without deformations and that the front end side portions converge into a conical shape without deformation that progressively decreases in diameter. At the same time, the hemisphere-divided portions 21 at the front ends are also brought together through elastic engagement between the combtooth pieces 2 to form a smooth hemispherical writing tip 5 with no undulations, as shown in FIG. 10 and FIG. 11. The writing tip 5, made up of a plurality of front ends of the combtooth pieces 2 combined, looks like petals in cross section. A periphery of the tip portion 51 constitutes a writing portion that is placed in contact with a paper surface for writing. At interface portions on both sides of each combtooth piece 2, i.e., between the adjoining combtooth pieces 2, are formed ink feeding paths 6 shaped like capillary slits.

Figure 12:
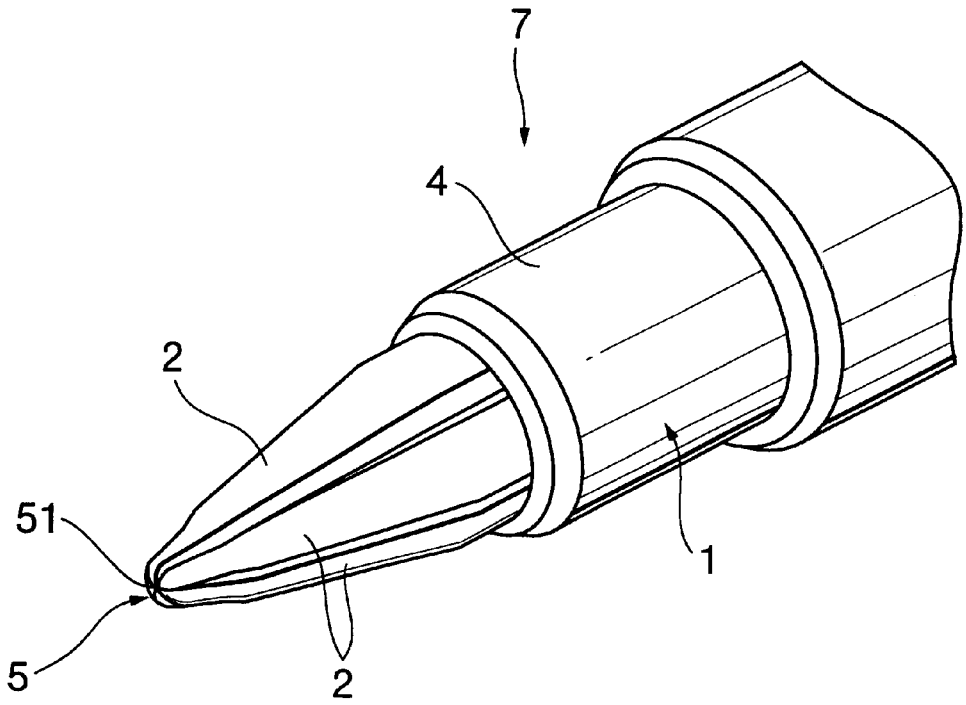
FIG. 12 is a perspective view showing a part of a writing instrument using the nib.

Next, a writing action of a writing instrument using this nib 1 will be explained with reference to FIG. 12 through FIG. 17. FIG. 12 shows a writing instrument 7 using this nib 1. In this writing instrument 7, the combtooth pieces 2 of the nib 1 constitute divided pieces that together form a conical shape and are independent of each other at the front ends. That is, each of the combtooth pieces 2 has a hemisphere-divided molded portion at the front end, one of divided parts of a hemisphere portion at the front end of the nib; and each combtooth piece 2 is shaped in cross section like one of divided, curved segments of a cone over a length up to where it is connected to and secured in the cylindrical holder member 3 (FIG. 3). Thus, each combtooth piece 2 is supported like a cantilevered triangular plate with one end fixed in the holder member 3, i.e., it has the same structure as a cantilevered beam with one end fixed. Therefore, when, during the use of the writing instrument 7, a writing pressure acts on the nib 1 applying an upward force (deflecting force) to the front end of the combtooth piece 2, the combtooth piece 2 is deflected with a portion fixed by the converging member 4 acting as a fulcrum. When released from this upward pressing force, the combtooth piece 2 restores its original shape.

Figure 13:
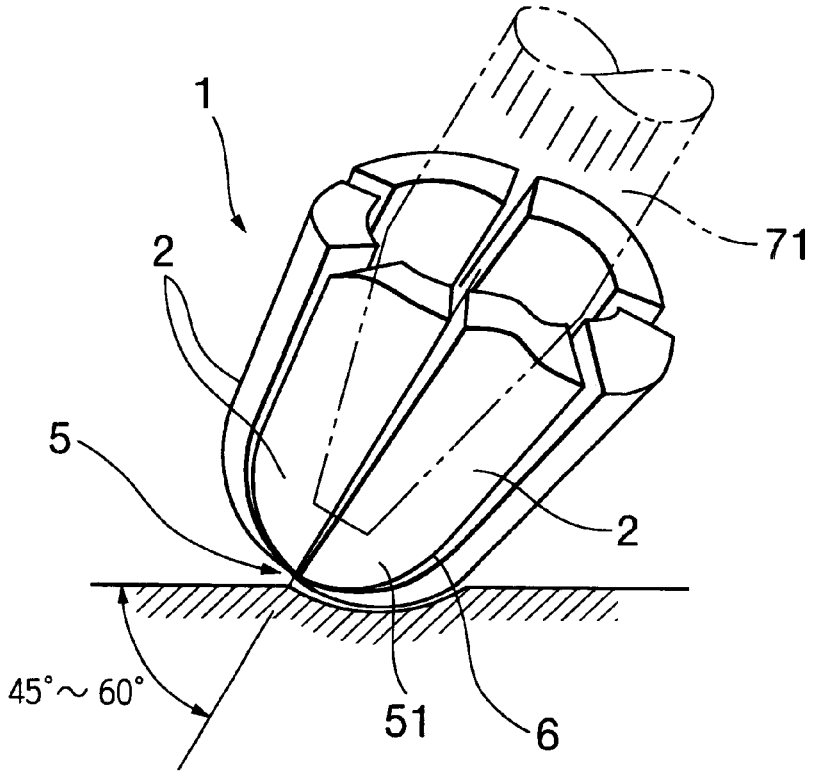
FIG. 13 is a partial perspective view showing the writing tip of the nib pressed against a paper surface.

When viewed three-dimensionally, the tip portion 51 of the nib 1, that forms the hemispherical writing tip 5 made up of the front end portions of the combtooth pieces 2 converged into a conical shape, is as shown in FIG. 13, FIG. 14A or FIG. 16A. FIG. 13 is a perspective view showing only a conical portion of the nib comprised of six combtooth pieces 2, with the tip portion 51 in contact with a paper surface. In FIG. 13 reference number 71 represents an ink feeding core.

As shown in FIG. 13, when, during the use of the writing instrument 7, the nib 1 is placed in contact with paper at an angle in a practical range of between about 45° and 60°, ink that is introduced to joint gaps in the tip portion 51 of the nib 1, i.e., to the inside of the front end portion of the ink feeding paths 6, is drawn out by a capillary attraction that develops at a contact area between the paper surface and the tip portion 51, the ink being distributed onto the paper surface to draw a line. Elastic deformations (or elastic deforming actions) of the hemispherical writing tip 5 caused by the writing pressure are shown in FIG. 14 to FIG. 17.

Figure 14:
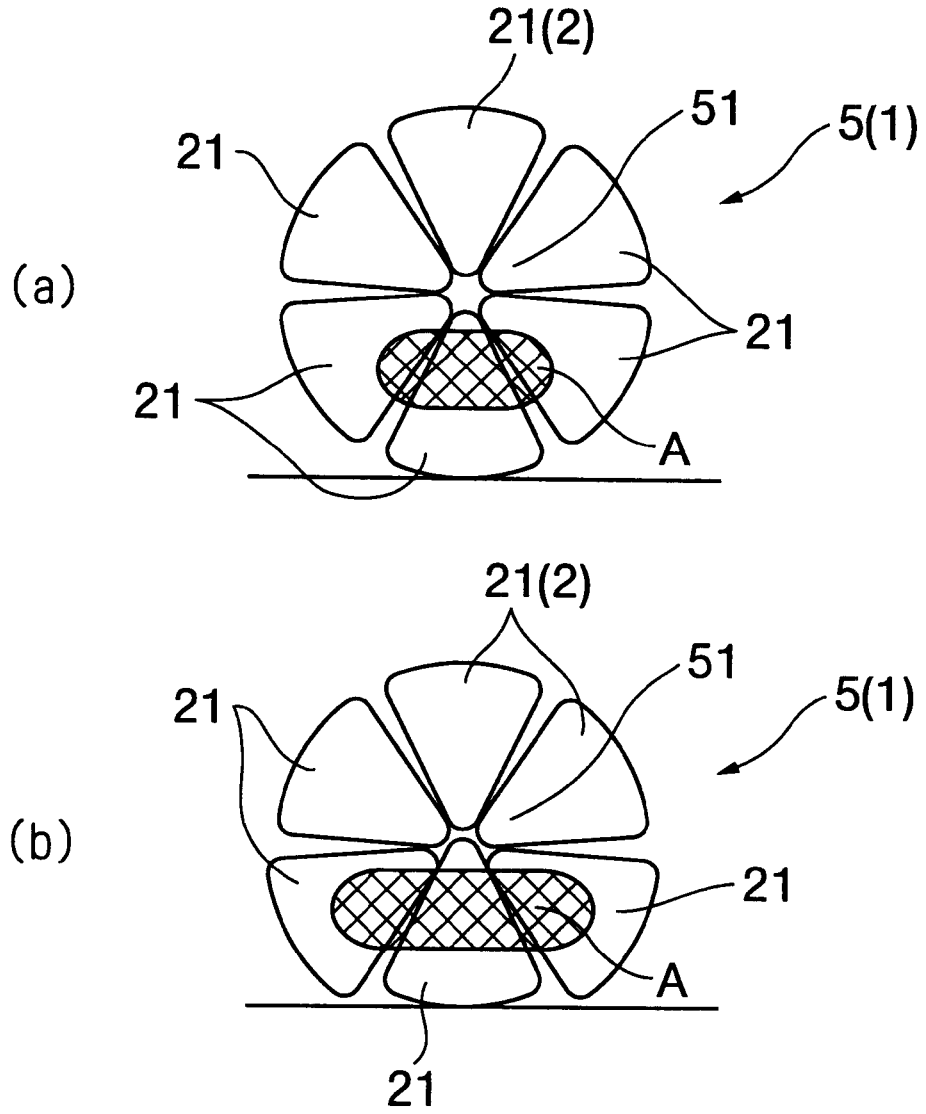
FIG. 14 is a front end view showing how the writing tip behaves.
Figure 15:
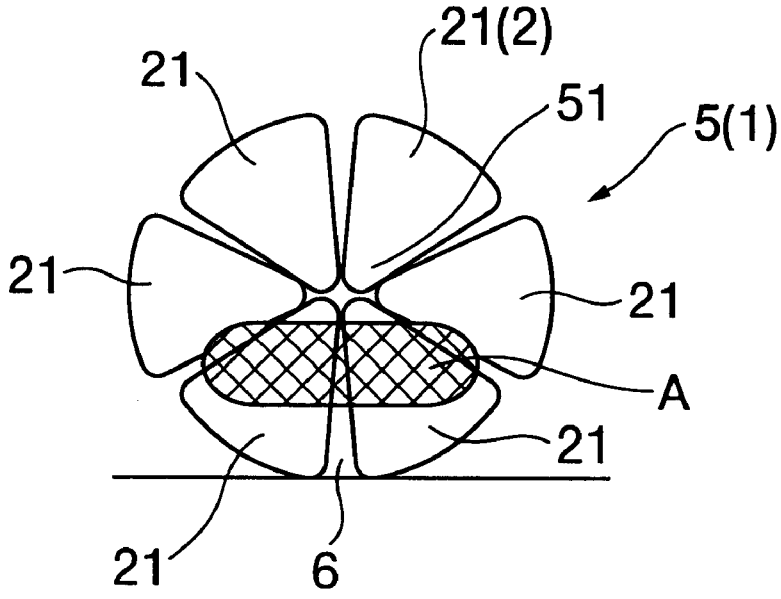
FIG. 15 is a front end view showing how the writing tip behaves.
Figure 16:
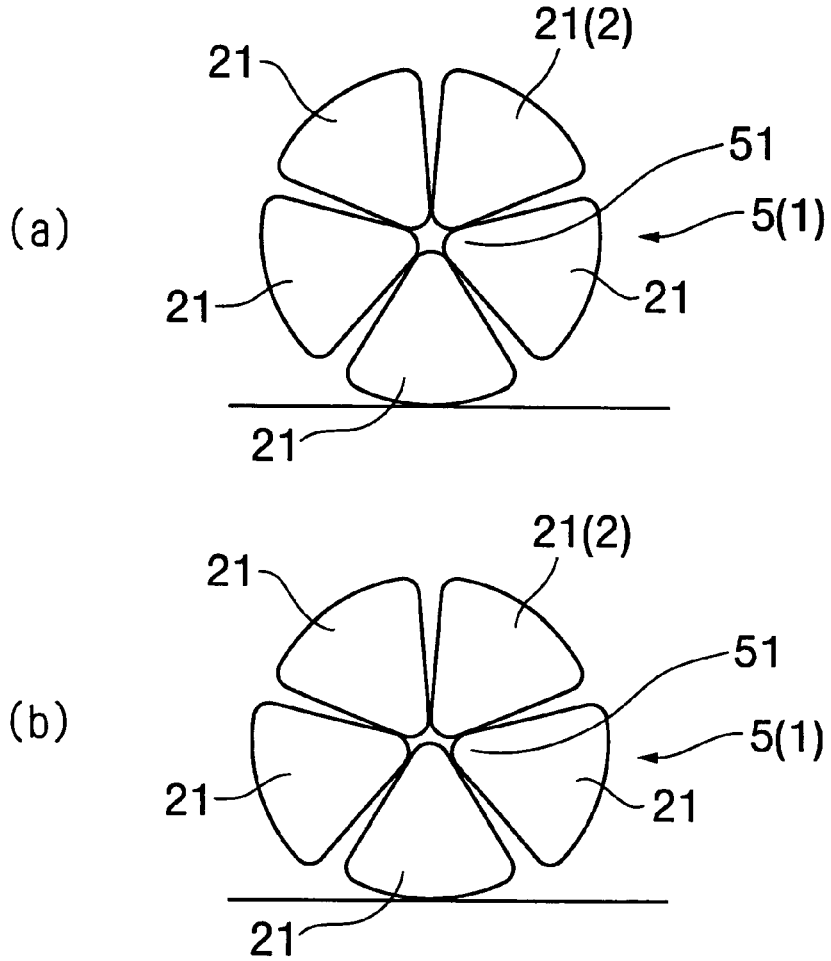
FIG. 16 is a front end view showing how the writing tip made up of a different number of combtooth pieces behaves.
Figure 17:
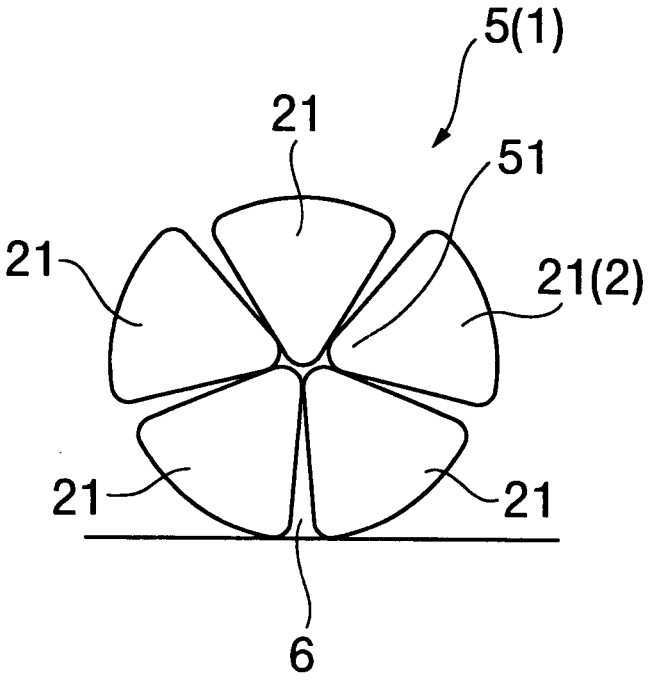
FIG. 17 is a front end view showing how the writing tip made up of the different number of combtooth pieces behaves.

FIG. 14 and FIG. 15 are end views showing changes in shape, during a writing operation, of the writing tip 5 of a nib 1 whose conical portion is made up of six combtooth pieces 2. FIG. 16 and FIG. 17 are end views showing changes in shape of the writing tip 5 of a nib 1 during the writing operation when the conical portion of the nib is made up of five combtooth pieces 2. FIG. 14A illustrates a state of the tip portion 51 when the pen is held close to a paper surface so that at the tip of the nib 1 one of the combtooth pieces 2 assumes a bottom position directly below the center axis of the nib and the tip portion 51 is still out of contact with or lightly in contact with the paper surface and is applied with no writing pressure. In this state, because none of the combtooth pieces 2 is applied a deflecting force, they are in elastic contact with one another. Next, when a writer applies a writing force to the nib, the tip portion 51 as the front ends of the combtooth pieces 2 is deflected by the writing pressure and moves up, with the fixed portions of the combtooth pieces 2 in the converging member 4 acting as a fulcrum. At this time, a stiffness of the material of the combtooth pieces 2 produces a resisting force which, under a normal writing pressure, restricts a distance the front end moves or a displacement of the tip portion 51 to a predetermined magnitude, for example 0.1–0.5 mm. Behaviors of the individual front ends of the combtooth pieces 2 making up the hemispherical tip portion 51 as seen from the front are as follows. Of a plurality of combtooth pieces 2 making up the tip portion 51, a combtooth piece 2 situated at the bottom of the nib is pushed up at its front end, forcing an opposing top combtooth piece 2 upward and pushing away sideways combtooth pieces 2 situated on both sides, as shown in FIG. 14B. As a result, the hemispherical tip portion 51 deforms and the writing tip 5 as a whole shifts.

When viewed as a whole, the outer diameter of the hemispherical portion and therefore the paper contact area increase. In FIG. 14B a shaded area A in which the nib contacts the paper surface expands. The degree of this expansion increases with a pressure with which the nib 1 is pressed against the paper surface, or the writing pressure. The thickness of a written line depends on the outer diameter of the tip portion 51. Since the line thickness increases as the hemispherical shape expands, lines can be drawn thick or thin depending on the magnitude of the writing pressure. Further, according to the magnitude of the writing pressure, the combtooth pieces 2 as a whole deflect, producing a cushion effect whereby the writing pressure, if large, can be absorbed by the entire combtooth pieces 2.

Unlike FIGS. 14A and 14B, FIG. 15 shows a deformed state of the tip portion 51 when the pen is held close to a paper surface so that at the tip of the nib 1 one of ink feeding paths 6 between two combtooth pieces 2 comes directly below the center axis of the nib and the tip portion 51 is applied a writing pressure. Behaviors of the individual front ends of the combtooth pieces 2 making up the hemispherical writing tip 5 as seen from the front are as follows. Of a plurality of combtooth pieces 2 making up the tip portion 51, two combtooth pieces 2 situated at the bottom of the nib are pushed up at their front ends by the writing pressure, forcing away sideways adjoining combtooth pieces 2, thereby elastically deforming the hemispherical tip portion 51. Other actions or behaviors are the same as those explained in conjunction with FIG. 14A and FIG. 14B. In other writing states than those shown in FIG. 14A, FIG. 14B and FIG. 15, that is, whatever rotating angle position about the pen axis the nib 1 takes, when the tip portion 51 of the nib 1 engages with a paper surface at an angle, the writing tip 5 slightly expands due to elastic deformation and performs the similar actions or behaviors to those described above.

In the case of FIG. 16, deformations similar to those described in conjunction with FIG. 14 also occur during the writing operation. FIG. 16A shows a state of the tip portion 51 when the pen is held close to a paper surface so that at the tip of the nib 1 one of the combtooth pieces 2 assumes a bottom position directly below the center axis of the nib and the tip portion 51 is still out of contact with or lightly in contact with the paper surface and is applied with no writing pressure. In this case, since none of the combtooth pieces 2 is applied a deflecting force, they are in elastic contact with one another. Next, when a writer applies a writing force to the nib, the tip portion 51 as the front ends of the combtooth pieces 2 secured in the holder member 3 is deflected by the writing pressure and moves up. The displacement of the tip portion 51, when subjected to a normal writing pressure, is within a range of 0.1 to 0.5 mm as in the case of FIG. 14. Behaviors of the individual front ends of the combtooth pieces 2 making up the hemispherical tip portion 51 as seen from the front are as follows. The conical portion of the nib 1 in this case is comprised of five combtooth pieces 2. Of these combtooth pieces 2 making up the tip portion 51, a combtooth piece 2 situated at the bottom of the nib is pushed up at its front end, forcing away sideways combtooth pieces 2 situated on both sides, as shown in FIG. 16B. As a result, the hemispherical tip portion 51 deforms.

FIG. 17, unlike FIG. 16A and FIG. 16B, shows a deformed state of the writing tip 5 when the pen is held close to a paper surface so that at the tip of the nib 1 one of ink feeding paths 6 between two combtooth pieces 2 comes directly below the center axis of the nib and the tip portion 51 is applied a writing pressure. Behaviors of the individual front ends of the combtooth pieces 2 making up the hemispherical tip portion 51 as seen from the front are as follows. Of a plurality of combtooth pieces 2 making up the tip portion 51, two combtooth pieces 2 situated at the bottom of the nib are pushed up at their front ends by the writing pressure, forcing up an opposing top combtooth piece 2 through a coordinated action of the bottom combtooth pieces 2 and pushing away sideways combtooth pieces 2 situated on both sides. As a result, the hemispherical tip portion 51 is deformed. Other actions or behaviors are the same as those described earlier. Although FIG. 17 does not show an area A, shown shaded in FIG. 15, in which the nib contacts the paper surface, the similar contact area A develops also in the case of FIG. 17 during the writing operation.

In the first embodiment described above, since the nib 1 is formed by assembling a plurality of separate combtooth pieces 2 using the holder member 3 and the converging member 4, these components can be made simple in shape. This in turn minimizes variations in dimensional and positional accuracies during the manufacturing process, assuring a high-yield mass production of such nibs. With this construction it is also possible to chamfer or round the outer surface corners of the tip easily and supply inexpensive products in large quantities.

Further, five to eight combtooth pieces 2 are secured at one end to the holder member 3 and have the converging member 4 sleeved thereover. In this construction, the uniform pressure of the converging member 4 ensures that the five to eight combtooth pieces 2 are formed into a conical shape without deformations; at the tip of the nib is formed the hemispherical writing tip 5 which has the combtooth pieces correctly aligned; the ink feeding paths 6 are formed between the combtooth pieces 2. With this construction, when the hemispherical writing tip 5 is pressed against a paper surface with its center axis at an angle to the paper, the hemisphere-divided portions 21 at the front ends of the combtooth pieces 2 shift relative to each other, resulting in an elastic deformation of the writing tip 5, which in turn increases an outer diameter of the hemispherical portion at the tip; and when the action of pressing the hemispherical writing tip 5 against the paper surface is eliminated, the tip portion returns to its original hemispheric shape by elasticity. The above-described behavior of the nib, therefore, allows the nib to write on a paper surface in any direction and, even if the nib is rotated about the pen axis, to write at any position on the hemispherical tip portion and at any angle. Further, by adjusting a writing pressure, it is possible to change the thickness of a line, allowing a writer to write a variety of modes of letters with a changing line width, such as those produced by a writing brush. According to the magnitude of the writing pressure, the combtooth pieces 2 deflect to absorb the writing pressure. This cushion effect gives the writer a soft writing feel, so that the writer can continue writing for many hours without fatigue. The cushion effect also reduces the deformation and wear of the tip of the nib when subjected to a high writing pressure, thus improving the durability of the writing tip. Further, if a pen is left unused for many hours or if water evaporates from the surface of the tip of the nib, drying ink and clogging fine ink feeding gaps at the tip, the restarting of writing causes the hemispherical writing tip 5 to deform and fine gaps to move, breaking a dry ink film or lump and allowing ink to be drawn out.

If, in the first embodiment, the number of divisions of hemispherical writing tip 5 is reduced as by using four or less combtooth pieces 2 instead of five to eight combtooth pieces 2 in constructing the conical portion of the nib, the intervals of the interfacing portions formed between the combtooth pieces 2 and constituting the ink feeding paths 6 become large when compared with the outer diameter of the writing tip. When the nib 1 is placed in contact with a paper surface, a distance between the paper surface and the ink feeding paths may increase depending on the angle of the nib with respect to the paper surface. In that case, since the portion that draws out ink by the capillary attraction is not close enough to the paper surface, a smooth feeding of ink may be interrupted. Therefore, the angle of the nib with respect to the paper surface needs to be restricted to some extent. One of the features of the nib according to this invention is an ability to write smoothly and freely in any direction with respect to the center axis and in as wide a range of writing angle as possible, for example, between 90° and 45°. However, by limiting this writing angle to some extent, it is possible to reduce the number of divisions of the conical portion to four or three and still produce the similar effects and advantages, as long as the similar construction is employed in which the hemisphere-divided portions at the tip shift relative to each other and in which the writing tip slightly expands according to the magnitude of the writing pressure applied.

As described above, the first embodiment offers the following advantages.

(1) Since the shape of the product is simplified, the die cost can be reduced to half the conventional cost.

(2) The molding process conventionally requires a 45-t molding press. By modifying the conical shape, the molding can be done with a press of about 10 tons, thus reducing the facility cost to one third the conventional one.

(3) The nib of the conventional construction can only be manufactured at the rate of 150–200 nibs per minute at most. The adoption of the nib construction of this invention increases the rate of production to 5,000 nibs per minute (5 nibs as one set), which is five times the conventional production rate, resulting in a significant reduction in the production cost.

(4) Since the combtooth pieces of the nib are formed as single, separate parts, the dimensional accuracy can easily be checked, preventing faulty parts from getting into the production line.

(5) Since the combtooth pieces of the nib are individually subjected to the process of chamfering or rounding the outer surface corners of the front end of each combtooth piece, the problem of the combtooth pieces interfering with one another is eliminated, enabling a large quantity of nibs to be manufactured in a short period of time. Furthermore, the assembly of individual combtooth pieces can be done by using an automated feeding apparatus, such as parts feeder, thus realizing a substantial cost reduction.

(Embodiment 2)

Figure 18:
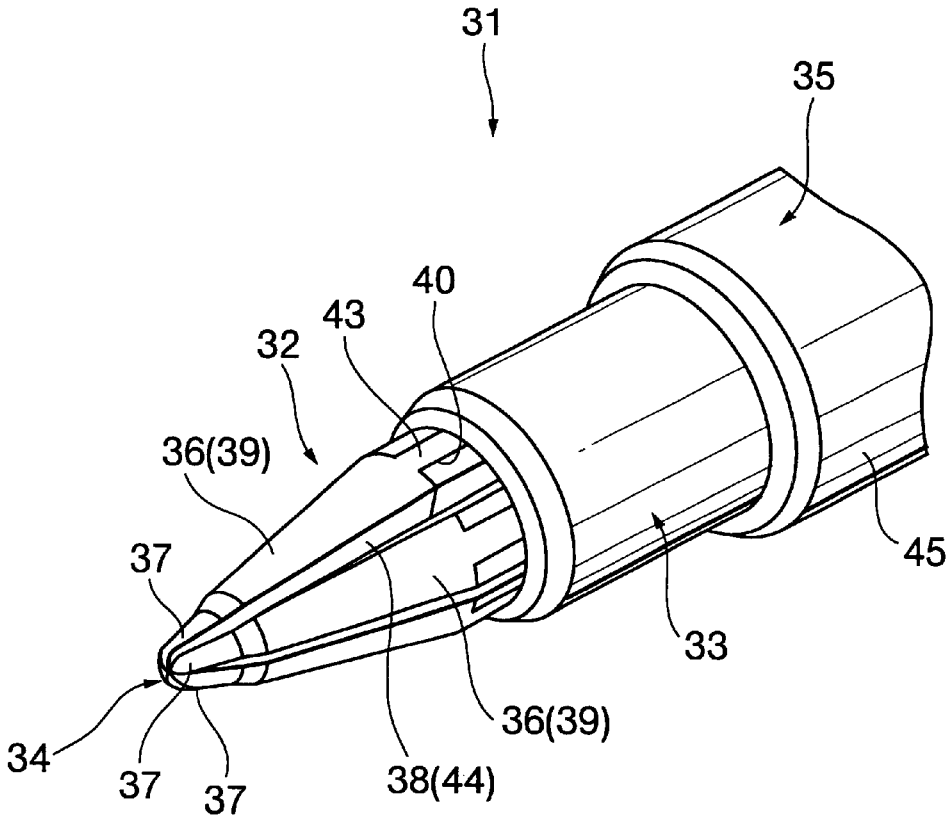
FIG. 18 is a perspective view of a ceramic composite conical nib according to a second embodiment of the present invention.

FIG. 18 shows an overall construction of a ceramic composite conical nib (hereinafter referred to simply as a nib) according a second embodiment of this invention. In FIG. 18, reference numeral 31 represents a nib comprising a nib base body 32 and a converging member 33.

Figure 19:
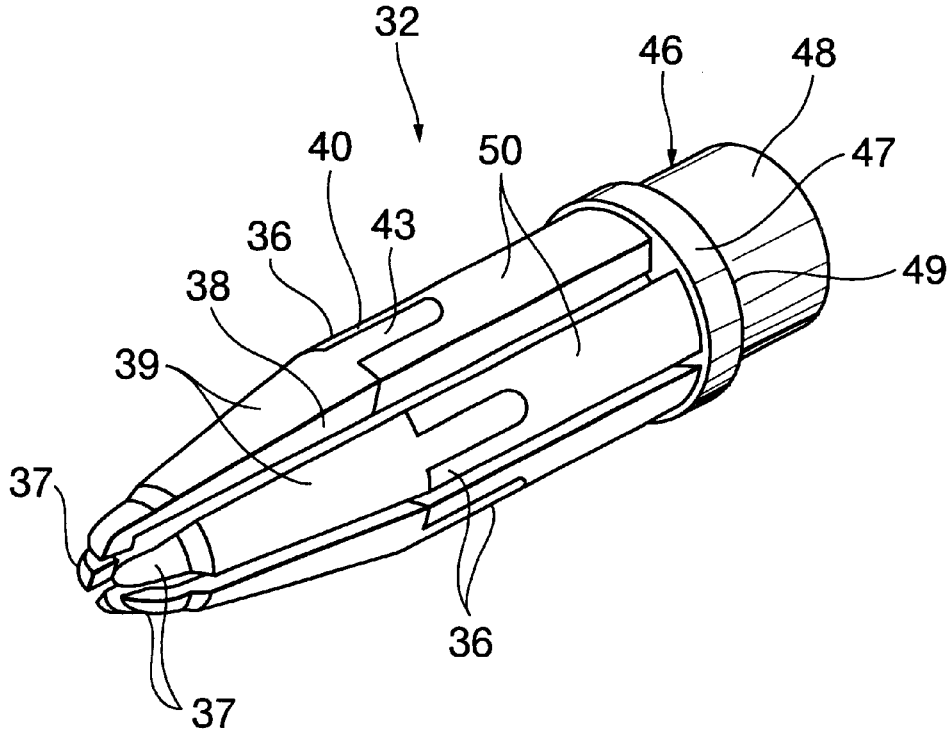
FIG. 19 is a perspective view of nib base body of the nib.

The nib base body 32, as shown in FIG. 19, comprises a cylindrical base portion 46, a plurality of combtooth pieces 36 and a plurality of hemisphere-divided portions 37. The combtooth pieces 36 are arranged at one end of the base portion 46 along a circumference, centered at a center axis of the nib, at equal intervals and are constructed to be able to converge progressively toward the front end and combine to form a roughly conical nib body. The hemisphere-divided portions 37 are formed at the front ends of the combtooth pieces 36 and can be combined together to form a virtually hemispherical tip. The nib base body 32 has five to eight combtooth pieces 36. These combtooth pieces 36 each comprise a front piece 39 including the hemisphere-divided portion 37 and a rear piece 50 on the rear side of the front piece 39. The front piece 39 and the rear piece 50 are set to have almost equal lengths.

Figure 20:
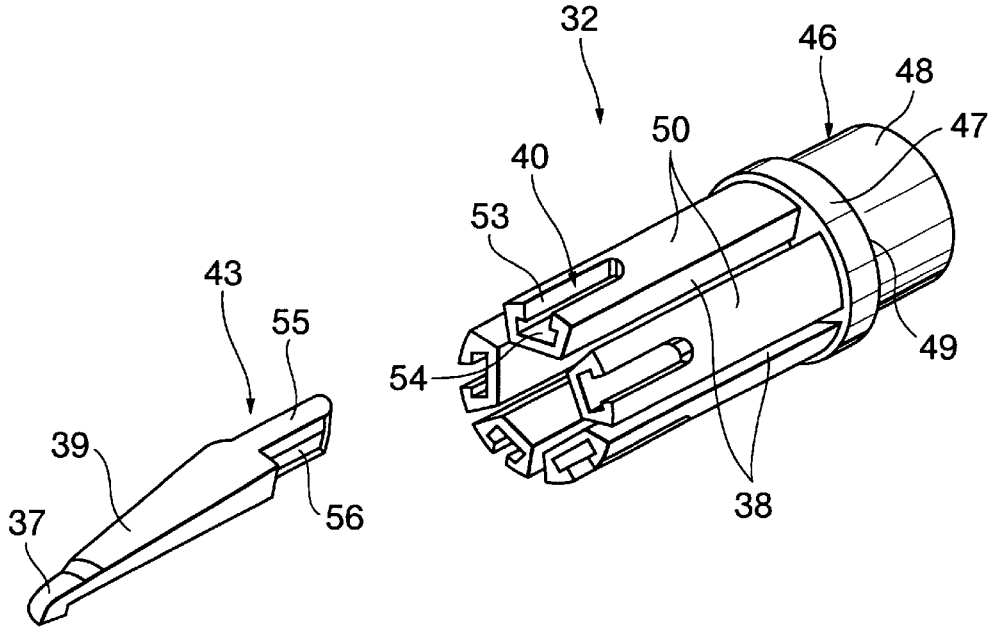
FIG. 20 is an exploded perspective view of a nib base body of the nib.
Figure 21:
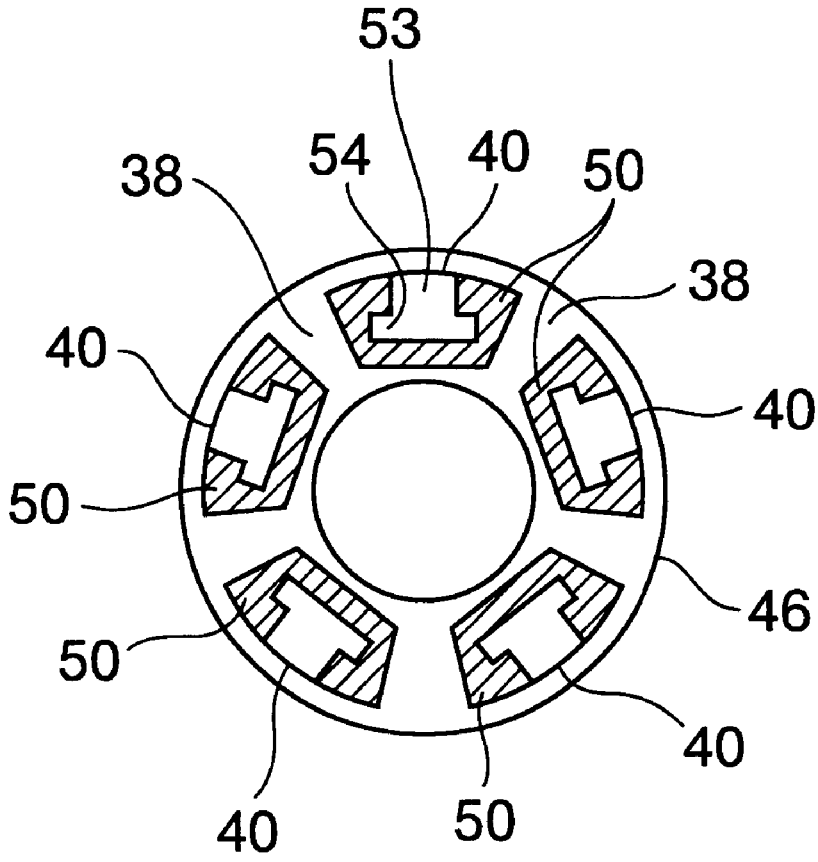
FIG. 21 is a transverse cross-sectional view of rear pieces mounted on the nib base body of the nib.

As shown in FIG. 20, the base portion 46 and the rear pieces 50 of the combtooth pieces 36 are integrally molded of an elastic synthetic resin by injection molding. The base portion 46 comprises a large-diameter portion 47 and a small-diameter portion 48 with a stepped portion 49 formed at their boundary. The rear pieces 50 of the combtooth pieces 36, each shaped like an arc in cross section, are arranged at equal intervals along an outer circumference of one end face of the large-diameter portion 47 of the base portion 46 and protrude linearly almost parallel to the center axis. Between each rear piece 50 is provided a slit 38. The rear pieces 50 therefore constitute divided segments of a virtually cylindrical body as shown in FIG. 21 and are curved in cross section and integrally connected to the base portion 46. In this configuration, the rear pieces 50 each constitute a cantilevered plate with its boundary portion adjoining the base portion 46 serving as a fixed end. In other words, the rear pieces 50 have the same structure as a cantilevered beam with one end fixed. Therefore, in the normal state of an integrally molded product of the base portion 46 and the five to eight rear pieces 50, the rear pieces 50 are spaced from each other. These rear pieces 50 are converged into a generally cylindrical shape by applying a pressing force from their outer circumference toward the center axis. Further, as shown in FIG. 20, the rear pieces 50 are formed on the front end side with engagement grooves 40 for coupling the front pieces 39. Each engagement groove 40 is shaped like an inverted letter T in cross section and extends axially from the front end of the rear piece 50 over a distance about one third the total length of the rear piece 50. The engagement grooves 40 each have a narrow groove 53 on the outer circumferential side and a wide groove 54 on the inner circumferential side, as shown in FIG. 21.

Figure 22:
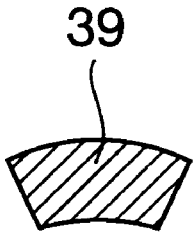
FIG. 22 is a partial cross-sectional view of a single front piece mounted on the nib base body of the nib.

As shown in FIG. 20, the front piece 39 of each combtooth piece 36 is formed integral with the hemisphere-divided portion 37 and made from a ceramic material. The ceramic material (powder of zirconia, alumina, silicon nitride and silicon carbide) is molded under pressure as by compression molding or injection molding into a one-piece body, which is then fired at elevated temperatures of 1300–1500° C. The front pieces 39 are formed in arc in cross section as shown in FIG. 22 so that they can continuously connect to the associated rear pieces 50. The front pieces 39 also are formed to progressively taper off toward the front end and incline in a direction in which they progressively approach the center axis toward the front end. The hemisphere-divided portions 37 at the tip each constitute one of five to eight divided segments of the hemispherical portion. Further, outer surface corners of each hemisphere-divided portion 37, i.e., corners formed by an outer surface of the hemisphere-divided portion 37 and its side surfaces, are polished as by blasting, barrel polishing and buffing to round them (or give them an R surface) so that the hemisphere-divided portions 37 do not get caught in a paper surface when they come into contact with it. The rounding of the outer surface corners of the hemisphere-divided portions 37 may be performed by barrel polishing before or after connecting the front pieces 39 to the rear pieces 50.

Figure 23:
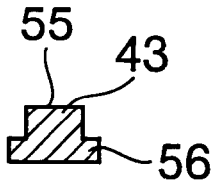
FIG. 23 is a partial cross-sectional view of a single front piece mounted on the nib base body of the nib.
Figure 24:
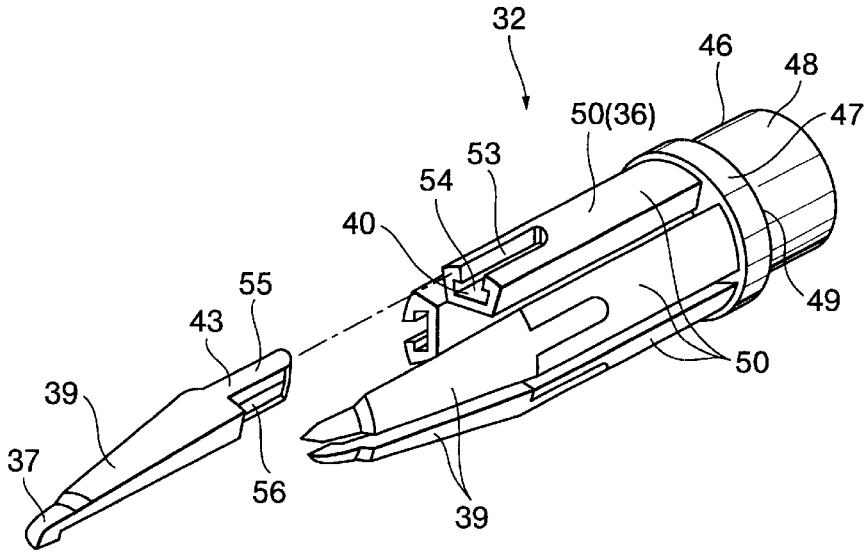
FIG. 24 is an exploded perspective view of the nib base body of the nib.

The front pieces 39 each have on the rear end side an engagement projection 43 engageable with the associated engagement groove 40 of the rear piece 50. The engagement projection 43 has a cross section shaped like an inverted letter T that matches the cross section of the engagement groove 40 of the rear piece 50 and, as shown in FIG. 23, has a narrow engagement projection portion 55 to be engaged in the narrow groove 53 on the outer circumferential side of the rear piece 50 and a wide engagement projection portion 56 to be engaged in the wide groove 54 on the inner circumferential side of the rear pieces 50. As shown in FIG. 24, the engagement projection 43 of each front piece 39 is placed in front of, and aligned with, the associated engagement groove 40 of the rear piece 50 and pushed into the engagement groove 40 for secure engagement. The front piece 39 thus connected conforms to the extension of each rear piece 50. This connecting work is mainly performed by a coupling machine but may be done manually.

As described above, the rear pieces 50 of synthetic resin and the front pieces 39 of ceramic are combined to form five to eight composite combtooth pieces 36, which are arranged along a circumference, centered at the center axis, with a predetermined gap between them. In the normal state, therefore, the combtooth pieces 36 are spaced from each other. The ceramic front piece 39 as a whole is hard and does not bend, but since it is combined with the elastic rear piece 50 molded of synthetic resin, the pressing or lifting of the combtooth piece 36 toward or away from the center axis permits the front piece 39 to follow the bending or deflecting motion of the rear piece 50.

In the nib base body 32, a plurality of combtooth pieces 36 are arranged along a circumference at predetermined intervals (slits 38) and, rather than being converged into a roughly conical shape, are kept relatively open or spaced apart from each other at the front end side. This configuration enables the front pieces 39 to be secured to the rear pieces 50 of the combtooth pieces 36 easily, with a sufficient space available between each rear piece 50 facilitating the coupling operation. In the manufacture of the nib base body 32, this configuration also facilitates the production of dies. Particularly because the intervals of the rear pieces 50 of the combtooth pieces 36 are kept at a predetermined size by the slits 38, it is possible to secure sufficient dimensions used in injection molding and die fabrication, such as thicknesses and widths of fillet-like projections in cavities, so as to withstand a predetermined injection pressure and provide a required die strength. Further, since the front ends of the front pieces 39 constitute a writing tip 34, corners of the front end of each front piece 39 need to be rounded. Taking advantage of the spaced-apart arrangement of the hemisphere-divided portions 37 at the front ends of the combtooth pieces 36, the outer surface corners of each hemisphere-divided portion 37 can easily be polished as by blasting, barrel polishing and buffing to have the corners rounded and smoothed. This removes corners from each of the hemisphere-divided portions 37, which are converged to form a hemisphere writing tip. As a result, the writing tip, when brought into contact with the paper surface, can be prevented from getting caught in the paper and the smooth writing performance enhanced.

Figure 25:
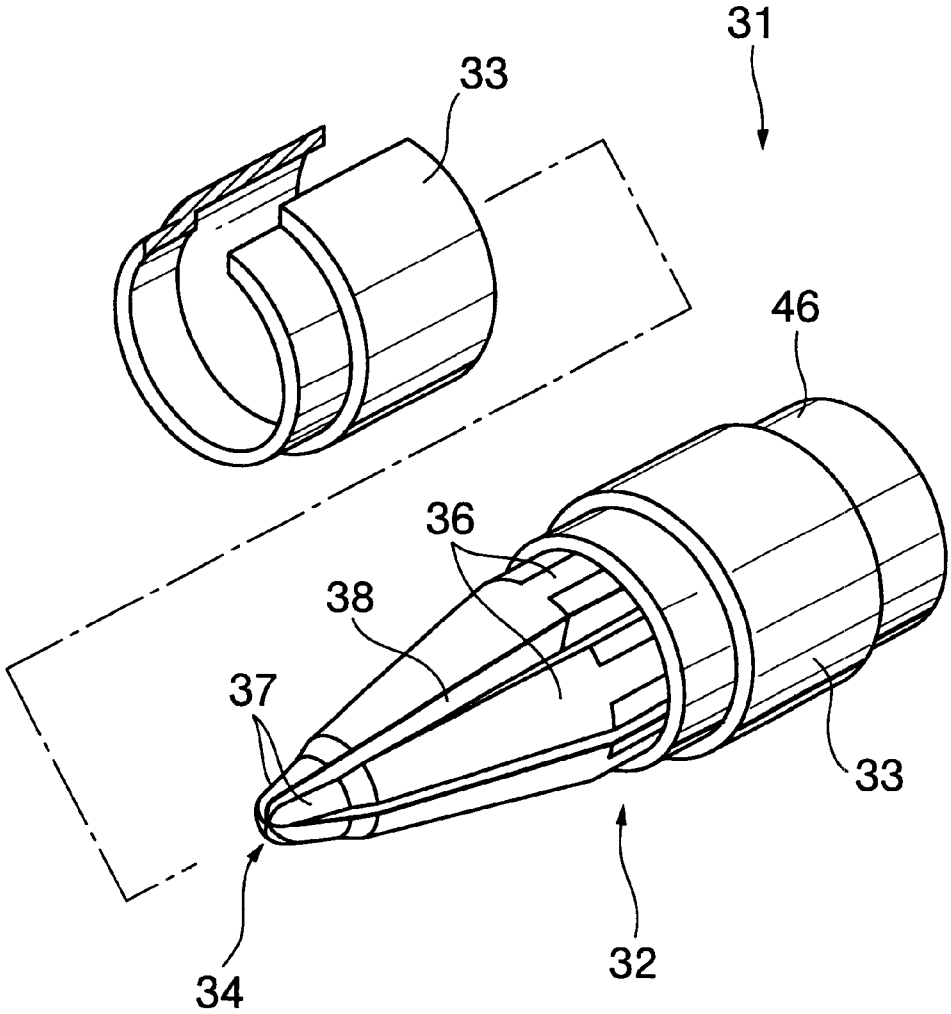
FIG. 25 is an exploded perspective view of a variation of the converging member used on the nib.

The converging member 33, as shown in FIG. 18, is also formed as a mouth piece to attach the nib 31 to a body portion 45 of a pen shaft 35. This converging member 33, or mouth piece, is integrally formed of synthetic resin and has at its inner circumference a fixing portion corresponding to the base portion 46 of the nib base body 32, and a throttling portion. An inner diameter of the throttling portion is so set as to press the rear pieces 50 of the combtooth pieces 36 of the nib base body 32 to converge the rear pieces 50 into a virtually cylindrical shape, the front pieces 39 into a virtually conical shape and the hemisphere-divided portions 37 into a virtually hemispherical shape (i.e., the inner diameter is set smaller than the diameter of an outer circumference of the rear pieces 50 of the combtooth pieces 36 in normal state). This converging member 33 may be formed from a metal pipe, as shown in FIG. 25. In that case, the converging member 33 is formed cylindrical so that it can be fitted over an intermediate portion of the nib base body 32, and has a stepped structure at its inner circumference that can press the combtooth pieces 36 toward the center axis to converge them into a conical shape which progressively decreases in diameter toward the front end.

Figure 26:
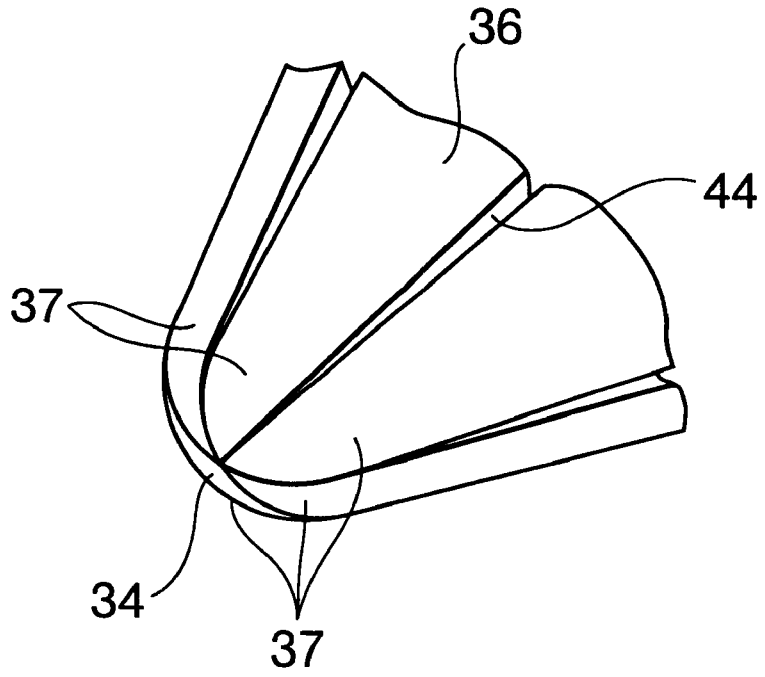
FIG. 26 is a perspective view of a writing tip of the nib.
Figure 27:
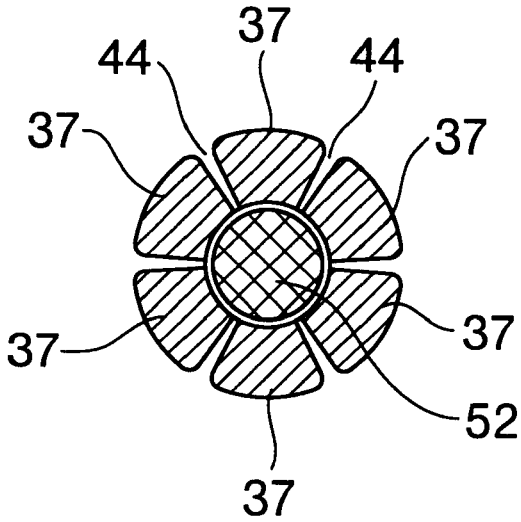
FIG. 27 is a cross-sectional view of the writing tip of the nib.

The nib 31 has the above-described nib base body 32 and converging member 33 as constitutional parts. To assemble them, the converging member 33 is sleeved from the front over the circumference of the nib base body 32 until it abuts against the stepped portion 49, as shown in FIG. 18 and FIG. 25. In this way, the converging member 33 is fixed on the rear pieces 50 of the five to eight combtooth pieces 36 of the nib base body 32 to press, by its front inner circumference, the rear pieces 50 of the combtooth pieces 36 from their outer circumference toward the center axis and thereby converge them with a uniform pressure. That is, the combtooth pieces 36 are converged under pressure inwardly toward the front end, with the rear pieces 50, which range from roughly central portions of the combtooth pieces 36 to the rear ends, being converged into a virtually cylindrical shape with no distortions and with the front pieces 39, which range from roughly central portions of the combtooth pieces 36 to the front ends, being converged into an undistorted virtually conical shape that progressively decreases in diameter. Thus, the adjoining combtooth pieces 36 elastically engage with each other and, as shown in FIG. 26 and FIG. 27, the interface portions on both sides of each combtooth piece 36, i.e., gaps between the adjoining combtooth pieces 36, become narrower toward the front end to form capillary slits which function as ink feeding paths 44. The adjoining hemisphere-divided portions 37 at the front end are brought together with no gap in between, thus forming a smooth, hemispherical writing tip 34 with no undulations. The writing tip 34, made up of a plurality of front ends of combtooth pieces 36, looks like petals in cross section. A periphery of the writing tip 34 constitutes a writing portion that is placed in contact with a paper surface for writing. As shown in FIG.

27, an ink feeding core 52 is installed into a hollow space in the nib base body 32 so that it is in contact with the inner surface of the nib base body 32 up to its front end. Ink is supplied through the ink feeding core 52 to the inner surface of the nib base body 32, from which the ink is further drawn out through capillary slits, or ink feeding paths 44, to the outer surface of the nib base body and to an outer surface of the hemispherical tip portion. When the hemispherical writing tip 34 contacts a paper surface, the ink is transferred onto the paper surface, thus allowing a writing operation. To facilitate the ink movement from the ink feeding core 52 installed inside the front end inner surface of the nib 31 to the front end outer surface, the converged portion needs to be provided with positive gaps (between interfacing surfaces of the adjoining, converged front ends). It is therefore preferred that the adjoining front ends of the converged portion be engaged with each other at their inner surface and spaced apart from each other at their outer surface.

The actions of a writing instrument, while in use, employing the nib 31 according to the second embodiment are similar to those of the first embodiment explained with reference to FIG. 14 to FIG. 17, and their descriptions are omitted here.

As described above, according to the second embodiment, since the tip portion of the nib 31 is made of a ceramic material, the tip portion is highly resistant to wear, significantly enhancing the durability of the nib 31, giving the writer a smooth writing feel and assuring smooth, uniform written lines for a long period of time. Further, if dried ink adheres to the writing tip, slight movements of the writing tip 34 as a result of the resumption of writing action, i.e., relative displacements among the hemisphere-divided portions 37 of the writing tip 34 and their elastic deformations, can cause an entire or part of the writing tip 34 to deform, changing the tip width according to the writing pressure and breaking the dry ink film to allow the ink to flow easily. Further, if fine dirt from the paper surface gets trapped in the writing tip 34, the dirt can be discharged immediately together with an ink flow.

Further, this embodiment has a simple structure in which the nib base body 32 comprises the base portion 46 and the five to eight combtooth pieces 36 and in which the converging member 33, in the form of a resin mouth piece or a metal pipe, is fitted over a portion of the nib base body between the base portion 46 and the combtooth pieces 36. In this simple structure, the five to eight combtooth pieces 36 are converged under a uniform pressure of the converging member 33 into a conical shape with no deformations, forming the ink feeding paths 44 between the combtooth pieces 36 and also forming at the front end of the nib the hemispherical writing tip 34 with no relative deviations among the hemisphere-divided portions 37. With this construction, when the hemispherical writing tip 34 is pressed against a paper surface with its center axis at an angle to the paper surface, the hemisphere-divided portions 37 at the front ends of the combtooth pieces 36 move relative to one another and elastically deform to expand the outer diameter of the hemispherical tip portion. When the pressing action is eliminated, the tip portion restores its original hemispherical shape by elasticity. Therefore, the nib can write on a paper surface in any direction and, even if the nib is rotated about the pen axis, write at any position on the hemispherical tip portion and at any angle. Further, by adjusting a writing pressure, the thickness of a line can be changed, allowing a writer to write a variety of modes of letters with a changing line width, such as those produced by a writing brush. According to the magnitude of the writing pressure, the combtooth pieces 36 deflect to absorb the writing pressure. This cushion effect gives the writer a soft writing feel, so that the writer can continue writing for many hours without fatigue. The cushion effect also reduces the deformation and wear of the tip of the nib when subjected to a large writing pressure, thus improving the durability of the writing tip.

Further, in this embodiment, since the five to eight combtooth pieces 36 of the nib base body 32 are open and spaced apart from one another at the front end side, the surface of the hemispherical tip portion can be polished efficiently as by buffing, barrel polishing and blasting to form a smooth writing tip 34 with ease. Further, since the combtooth pieces 36 are converged by a uniform pressing force of the converging member 33 into a conical shape, a conical nib with no deformations can be made easily.

(Embodiment 3)

Figure 28:
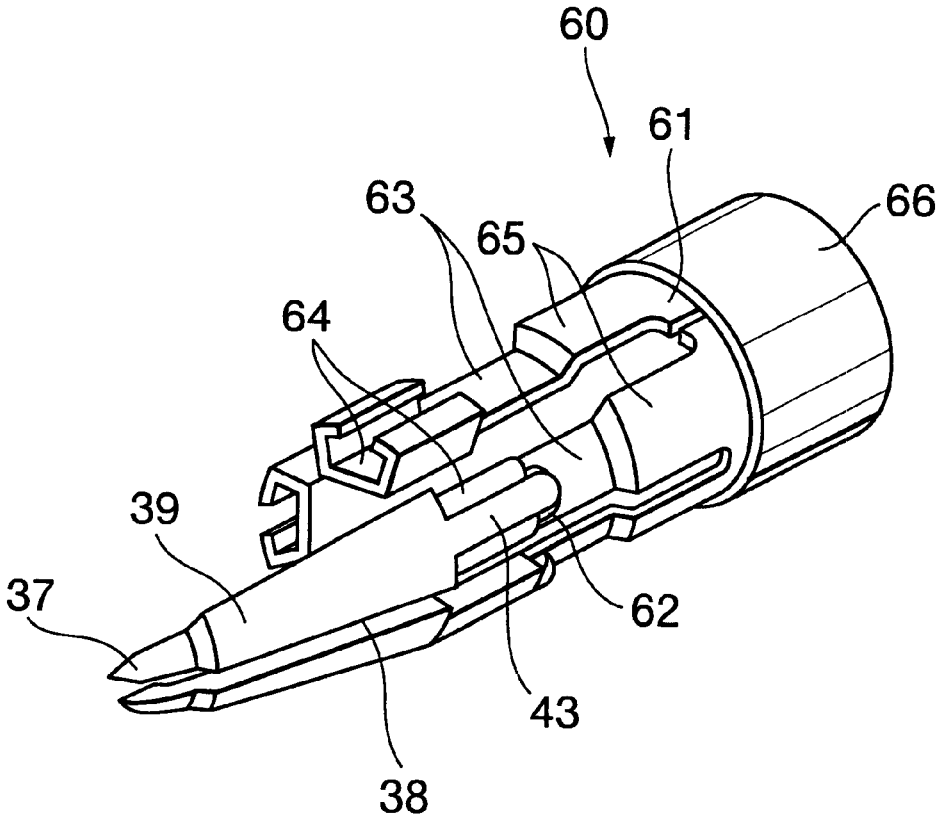
FIG. 28 is a perspective view showing a ceramic composite conical nib (nib base body) according to a third embodiment of the present invention.

FIG. 28 shows a construction of a nib base body 60 according to a third embodiment of the present invention. In this embodiment a base portion 61 and a plurality of rear pieces 63 of combtooth pieces 62 are integrally formed from a metal plate by stamping. That is, as in the second embodiment, the base portion 61 is formed cylindrical, and the five to eight rear pieces 63 are arranged at one end of the base portion 61 along a circumference, centered at a center axis of the nib, at equal intervals, with a slit 38 formed between each rear piece 63. Each rear piece 63 has a cantilevered structure in which a part of the rear piece 63 on the base portion 61 side is made an elastic portion 65 and a front side portion of the rear piece 63 is bent inwardly. The front side portion of each rear piece 63 is formed with an engagement groove 64 into which to insert the ceramic front piece 39. This engagement groove 64 is formed by bending side pieces of the rear piece 63 toward each other so that a space enclosed by the bent side pieces is shaped like an inverted letter T in cross section, the side pieces extending axially from the front end face of the rear piece 63 over a distance approximately one third the entire length of the rear piece 63. Then, an outer cylinder 66 of metal is fitted under pressure over the outer circumference of the base portion 61 to securely hold the entire nib base body 60.

The base portion 61 and the combtooth pieces 62 thus assembled are connected with the front pieces 39 of ceramic, as in the second embodiment. In the connecting operation, the engagement projection 43 of each front piece 39 is placed in front of, and aligned with, the associated engagement groove 64 of each rear piece 63 and pushed into the an engagement groove 64 for secure engagement. The front piece 39 thus connected conforms to the extension of each rear piece 63. With the front pieces 39 and the rear pieces 63 combined in this manner, the converging member 33, in the form of a mouth piece or a metal pipe, is fitted over the rear pieces 63 of the nib base body 60, as in the second embodiment. A stepped structure of the converging member 33 presses the rear pieces 63 from the outside toward the center axis to converge them into a virtually cylindrical shape, the front pieces 39 into a virtually conical shape, and the hemisphere-divided portions 37 into a virtually hemispherical shape, respectively.

This construction can produce the similar actions and effects to those of the second embodiment.

In the second and third embodiments, if the number of divisions of hemispherical writing tip 34 is reduced as by using four or less combtooth pieces 36, 62 instead of five to eight combtooth pieces 36, 62 in constructing the conical portion of the nib 31, the intervals of the interfacing portions formed between the combtooth pieces 36, 62 and constituting the ink feeding paths 44 become large when compared with the outer diameter of the writing tip. When the nib 31 is placed in contact with a paper surface, a distance between the paper surface and the ink feeding paths may increase depending on the angle of the nib to the paper surface (the distance between the paper surface and the ink feeding paths decreases as the angle of the nib to the paper surface approaches a right angle; but when the pen is inclined close to the angle of 45°, the paper-to-feeding-path distance increases). In that case, since the portion that draws out ink by the capillary attraction is not close enough to the paper surface, a smooth feeding of ink may be interrupted. One of the features of the nib according to this invention is an ability to write smoothly and freely in any direction with respect to the center axis and in as wide a range of writing angle as possible, for example, between 90° and 45°. However, by limiting this writing angle to some extent, it is possible to reduce the number of divisions of the conical portion to four or three and still secure a high durability of the writing tip, a good writing feel, expressive written lines and a good ink feeding at the beginning of writing, as long as the similar construction is employed in which the hemisphere-divided portions at the tip shift relative to each other and in which the writing tip slightly expands according to the magnitude of the writing pressure applied.

As described above, according to the second and third embodiments, since the tip portion of the nib is made from a ceramic material, the tip portion has an increased wear resistance and an enhanced durability, gives a writer a smooth writing feel and produces smooth written lines. According to the writing pressure, the hemisphere-divided portions of the writing tip move relative to one another and as a whole deform elastically as a result of elastic deformations of the rear pieces. Because of this behavior, the writing tip of the nib, though made of a hard ceramic material, can prevent an interruption of ink feed which would otherwise be caused by an ink viscosity change due to drying of ink or by dried ink scum. Further, if dirt or paper dust adheres to ink paths, the above-described behavior of the writing tip can reliably remove it, assuring a stable writing action. The elastic deformation of the writing tip offers a soft paper-contacting feel and allows the nib to write at any angle to a paper surface and, even if the nib is rotated about the pen axis, at any position on the hemispherical tip portion. It is also possible to draw a line thick or thin by adjusting the writing pressure.

While the present invention has been described in conjunction with preferred embodiments by referring to the accompanying drawings, it will now be apparent from the foregoing to those skilled in the art that various changes and modifications may be made without departing from the spirit of the invention. This invention includes such modifications.

What is claimed is:

1. A conical nib comprising:

a plurality of separated combtooth pieces capable of converging progressively toward front ends thereof and combining to form a virtually conical shape over the entire length and a virtually spherical shape at the front ends;

a holding member having a holding portion capable of fixing base end portions of the plurality of combtooth pieces, the holding member being able to arrange the base end portions of the combtooth pieces along a circumference; and a converging member formed to be able to be fitted over an outer circumference of the plurality of combtooth pieces arranged along the circumference by the holding member, the converging member being adapted to press the combtooth pieces inwardly from outside to converge them;

wherein the plurality of separated combtooth pieces are assembled by the holding member and the converging member, both separate from the combtooth pieces, into a conical nib having a writing tip at the front end thereof and an ink feeding path between each combtooth piece.

2. A conical nib according to claim 1, wherein each of the combtooth pieces is formed generally like a pointed knife and has a fixed portion in each of the base end portions, the holding member is formed cylindrical and has at one end face thereof groove-shaped fixing portions into which the fixed portions of the combtooth pieces can be axially inserted, and the combtooth pieces are inserted into the fixing portions of the holding member.

3. A method of manufacturing a conical nib, comprising the steps of:

forming a plurality of separated combtooth pieces, the combtooth pieces being able to be converged generally into a virtually conical shape, the combtooth pieces having front ends that combine to form a virtually spherical shape;

forming a holding member having groove-shaped fixing portions into which base end portions of the plurality of combtooth pieces can be inserted, the holding member being able to arrange the base end portions of the combtooth pieces along a circumference; and forming a converging member capable of being fitted over an outer circumference of the combtooth pieces arranged along the circumference by the holding member to converge the plurality of combtooth pieces;

inserting the plurality of combtooth pieces into the fixing portions of the holding member to fix them along the circumference; and fitting the converging member over the outer circumference of the plurality of combtooth pieces to converge the combtooth pieces.

4. A ceramic composite conical nib comprising:

a nib base body having a cylindrical base portion, a plurality of combtooth pieces formed at one end of the base portion along a circumference, centered at a center axis thereof, the combtooth pieces being able to converge progressively toward front ends thereof and combine to form a virtually conical shape, and a plurality of hemisphere-divided portions formed at the front ends of the combtooth pieces, the hemisphere-divided portions being able to converge and combine to form a virtually hemispherical tip portion; and a converging member formed cylindrical and being able to be fitted over an outer circumference of the nib base body to converge the plurality of combtooth pieces and the hemisphere-divided portions thereof;

wherein each of the combtooth pieces has a front piece on a front end side thereof including the hemisphere-divided portion and a rear piece on a rear end side thereof;

wherein the front piece is formed from a ceramic material;

wherein the rear piece is formed elastically deformable from a synthetic resin or metal material;

wherein the nib base body is converged by the converging member to form an ink feeding path between each combtooth piece and also form a spherical writing tip at a front end thereof;

wherein when the writing tip comes into contact with a paper surface, the writing tip deforms and the hemisphere-divided portions thereof move relative to one another to expand the writing tip.

5. A ceramic composite conical nib according to claim 4, wherein the number of combtooth pieces of the nib base body is set in a range of between five to eight.

6. A ceramic composite conical nib according to claim 4, wherein the base portion and the rear pieces of the combtooth pieces are integrally formed from a synthetic or metal material.

7. A ceramic composite conical nib according to claim 4, wherein one of engagement surfaces of the front piece and the rear piece has an engagement projection and the other engagement surface has an engagement recess, and an engagement between the engagement projection and the engagement recess connects the front piece and the rear piece.

* * * * *